US007522478B2

(12) United States Patent
Moteki

(10) Patent No.: US 7,522,478 B2
(45) Date of Patent: Apr. 21, 2009

(54) TIMEPIECE

(75) Inventor: Masatoshi Moteki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/812,622

(22) Filed: Jun. 20, 2007

(65) Prior Publication Data

US 2008/0008052 A1 Jan. 10, 2008

(30) Foreign Application Priority Data

Jul. 10, 2006 (JP) ..... 2006-189812

(51) Int. Cl.
*G04B 19/00* (2006.01)
*G04B 25/00* (2006.01)

(52) U.S. Cl. ..... 368/269; 368/315

(58) Field of Classification Search ..... 368/98, 368/315, 99, 243, 244, 267–271
See application file for complete search history.

(56) References Cited

U.S. PATENT DOCUMENTS 2,194,448 A * 3/1940 Rhodes ..... 368/99
2,549,157 A * 4/1951 Auth et al. ..... 116/100
3,328,952 A 7/1967 Clark
3,352,102 A 11/1967 Schneider
7,021,819 B2 4/2006 Schmiedchen

FOREIGN PATENT DOCUMENTS

| | | |
|---|---|---|
| CH | 372602 | 6/1963 |
| DE | 1 831 986 | 5/1961 |
| GB | 492858 | 9/1938 |
| JP | 2004-525370 A | 8/2004 |

* cited by examiner

*Primary Examiner*—Vit W Miska
(74) *Attorney, Agent, or Firm*—Global IP Counselors, LLP

(57) ABSTRACT

A timepiece has a timekeeping mechanism for keeping and displaying the time, a hammer, a bowl-shaped sound source that sounds when struck by the hammer, a sound source mounting member for fastening the bowl-shaped sound source to the timekeeping mechanism, and a striking control means for causing the hammer to operate. The bowl-shaped sound source has a bottom part and a side wall part. The hammer, the striking control means, and at least a part of the timekeeping mechanism are disposed in an internal space between the bottom part and the side wall part of the bowl-shaped sound source. The sound source mounting member is attached to the center of the bottom part of the bowl-shaped sound source, and fastens the bowl-shaped sound source to the timekeeping mechanism so that the bowl-shaped sound source can move a prescribed distance within a range not contacting the case of the timepiece or the timekeeping mechanism.

6 Claims, 15 Drawing Sheets

TIMEPIECE

BACKGROUND

1. Field of Invention

The present invention relates to a timepiece that has a mechanism such as a sonnerie, a repeater, an alarm, or a timer for producing sound by a mechanical striking action.

2. Description of Related Art

Repeater timepieces that have an internal gong and hammer, and strike the gong with the hammer to make a sound are known from the literature. See, for example, JP-T-2004-525370.

The gong used in such timepieces is a substantially C-shaped metal ring disposed along the inside circumference of the case with only one end of the gong fastened to the main plate by a screw, for example, so that the other end of the gong is free and not fixed. As a result, when the hammer strikes the gong, the gong vibrates and produces sound.

When a gong is used as the sound source, however, the shape of the gong may result in a sound with little reverberation.

We therefore looked for a sound source that can be used inside a wristwatch, a pocket watch, or other small, wearable timepiece and that also produces a unique sound not possible with the related art.

We discovered that a novel reverberating sound that is not possible in timepieces according to the related art can be achieved by using a bowl-shaped sound source such as a bell, particularly a hanging bell.

However, such a bowl-shaped sound source occupies more space than the gong described above and requires some ingenuity to fit inside a small timepiece such as a wristwatch.

In addition, while the gong is simply fastened by tightly securing one end to the main plate, the method of fastening a bowl-shaped sound source greatly affects its tone and reverberation characteristic.

SUMMARY

A timepiece according to the present invention enables disposing a bowl-shaped sound source inside a wristwatch or other small, wearable timepiece, and achieves a tone and reverberation not possible with timepieces according to the related art.

A timepiece according to a preferred aspect of the invention has a timekeeping mechanism for keeping and displaying the time; a hammer; a bowl-shaped sound source that sounds when struck by the hammer; a sound source mounting member for fastening the bowl-shaped sound source to the timekeeping mechanism; and a striking control means for causing the hammer to operate. The bowl-shaped sound source has a bottom part and a side wall part. The hammer, the striking control means, and at least a part of the timekeeping mechanism are disposed in an internal space between the bottom part and the side wall part of the bowl-shaped sound source. The sound source mounting member is attached to the center of the bottom part of the bowl-shaped sound source, and fastens the bowl-shaped sound source to the timekeeping mechanism so that the bowl-shaped sound source can move a prescribed distance within a range not contacting the case of the timepiece or the timekeeping mechanism.

The timekeeping mechanism is an arrangement known from the literature such as a movement or a module for keeping and displaying the time. The timekeeping mechanism of the invention therefore includes analog devices that uses gears, springs, and motors, for example, to drive hands, and digital devices that use an IC device and battery to drive a liquid crystal display.

By attaching the center of the bottom of the bowl-shaped sound source to the timekeeping mechanism by means of an intervening sound source mounting member, this arrangement of the invention reduces the effect of the fastener on the vibration of the side wall, which particularly affects the sound produced by a hanging bell or other bowl-shaped sound source, and allows for longer sound reverberation.

Furthermore, because the sound source mounting member supports the bowl-shaped sound source so that the sound source can move only a prescribed distance when struck by the hammer, the energy transferred to the bowl-shaped sound source is not spent on deformation of the sound source or the sound source mounting member, attenuation of sound source vibrations is inhibited and the sound thus reverberates for a longer time. The arrangement of the invention thus produces a sound with a longer reverberation than when a gong is used as the sound source.

In addition, because the bowl-shaped sound source is set so that vibrations and shock resulting from normal use will not cause the sound source to contact the case or movement, the bowl-shaped sound source can be prevented from contacting the case and sounding during normal everyday use.

Further preferably, the sound source mounting member has a fixed part that is attached to the bottom part of the bowl-shaped sound source, and a plurality of fixed arm parts protruding from the fixed part. The fixed arm parts are attached with a prescribed intervening gap to the timekeeping mechanism, and this gap enables the bowl-shaped sound source to move the prescribed distance.

By attaching the fixed arm parts of the sound source mounting member to the timekeeping mechanism, the sound source can be attached to the timekeeping mechanism while avoiding the area around the center shaft where the drive shaft of the hands is provided. Changing the layout of the parts in the timekeeping mechanism is therefore not necessary, an existing timekeeping mechanism can be used, and the cost can therefore be reduced.

Furthermore, by attaching the sound source mounting member to the timekeeping mechanism with a prescribed intervening gap, the sound source mounting member can move the small distance afforded by this gap when the hammer strikes the bowl-shaped sound source. The energy transferred to the bowl-shaped sound source is therefore not spent on deformation of the sound source or the sound source mounting member, attenuation of sound source vibrations is inhibited and the sound thus reverberates for a longer time.

Further preferably, the sound source mounting member has a fixed part that is attached to the bottom part of the bowl-shaped sound source, and a plurality of fixed arm parts protruding from the fixed part. The fixed arm parts are flexible and are attached to the timekeeping mechanism by an intervening spring member that has less spring strength than the fixed arm parts, and deformation of the spring member enables the bowl-shaped sound source to move the prescribed distance.

This arrangement of the invention also uses fixed arm parts to attach the sound source mounting member to the timekeeping mechanism while avoiding the area of the center shaft. Attenuation of sound source vibrations is also reduced and the sound reverberation lasts longer when the hammer strikes the bowl-shaped sound source because the spring member deforms and allows the sound source mounting member to move a slight distance.

Further preferably, the sound source mounting member is a rubber bushing that is attached to the bottom part of the bowl-shaped sound source and is attached to the plane center bottom of the timekeeping mechanism.

When the hammer strikes the bowl-shaped sound source in this aspect of the invention, the rubber bushing used as the sound source mounting member elastically deforms so that the bowl-shaped sound source can move slightly. The energy transferred to the bowl-shaped sound source is therefore not spent on deformation of the sound source or the sound source mounting member, attenuation of sound source vibrations is inhibited and the sound thus reverberates for a longer time.

Further preferably, the timepiece also has a backup part that is disposed to the outside case and contacts the bowl-shaped sound source when the bowl-shaped sound source moves to prevent further movement beyond the range exceeding the elastic deformation limit of the sound source mounting member.

By providing this backup part on the case side of the bowl-shaped sound source, the bowl-shaped sound source contacts the backup part before exceeding the elastic deformation range of the sound source mounting member when the bowl-shaped sound source is moved by a strong shock, such as when the timepiece is dropped. The sound source mounting member can thus be reliably prevented from deforming to the plastic deformation range, and the impact resistance of the timepiece can be assured.

Further preferably, the timepiece also has a self-centering mechanism for returning the bowl-shaped sound source to the original position of the bowl-shaped sound source after the bowl-shaped sound source moves.

This self-centering mechanism causes the bowl-shaped sound source to automatically return to the original position after being struck by the hammer. The distance between the hammer and the side wall of the sound source therefore remains constant, the striking force of the hammer against the bowl-shaped sound source is held constant, and the resulting sound and reverberation can be kept constant.

The self-centering mechanism can be easily rendered using a spring or an incline and the weight of the bowl-shaped sound source.

The timepiece also preferably has a governor for regulating the operating speed of the hammer.

This governor preferably has a rotor that rotates using energy supplied from an energy storage means through a power transfer means; a wing having wing surfaces perpendicular to the rotational axis of the rotor, and disposed movably to an outside circumference side radially to the rotor by means of centrifugal force produced by rotor rotation; a wing returning means disposed between the rotor and wing for pulling the wing to the inside circumference side radially to the rotor; and an opposing object disposed to the outside circumference of the rotor and comprising an opposing surface located opposite and separated a predetermined gap from the wing surface when the wing moves to the outside circumference side radially to the rotor.

Thus arranged, energy from a spring or other energy storage means is transferred through wheels or other power transfer means to the rotor, and the rotor turns. When the rotor begins turning, the wing moves circularly together with the rotor and is subject to centrifugal force corresponding to the rotational velocity of the rotor. If this centrifugal force is less than the returning force of the wing returning means, the wing does not move to the outside. As the centrifugal force exceeds this returning force, the wing moves proportionally to the difference between the centrifugal force and the returning force in the direction away from the rotational axis of the rotor, that is, to the outside circumference side radially to the rotor.

When the wing moves to the outside circumference side radially to the rotor, the resistance of fluid viscosity corresponding to the amount of wing movement is applied to the wing. More specifically, when the rotor speed reaches a certain velocity, the wing that receives centrifugal force corresponding to the rotor speed overlaps the surface of the opposing object. If the distance between the wing surface and the opposing surface of the opposing object is set to a prescribed dimension that is less than the distance between the surrounding member and the wing surface, viscous resistance that is greater than the viscous resistance produced around the wing before the wing and opposing object surfaces overlap works between the wing and opposing object when the wing overlaps the surface of the opposing object. The viscous resistance therefore changes greatly at the speed at which the wing begins to overlap the opposing object. In other words, a cycle in which the rotor speed increases, wing movement increases, the wing and opposing object overlap and viscous resistance increases, the rotor speed then drops, the wing is pulled back, the wing stops overlapping the opposing object, the viscous load drops, and rotor speed then increases again repeats near the wing and opposing object boundary (the inside edge of the opposing object).

As a result, the rotor turns at a constant speed due to this continual change in resistance acting on the wing according to the rotor speed. Wing movement can therefore be set to maintain a desired rotor speed by appropriately setting the energy output of the energy storage means, the centrifugal force (which is determined by, for example, the wing weight, the location of the center of gravity of the wing, and the acceleration rate) acting on the wing, the viscosity of the viscous fluid (which is normally air but may be a liquid) between the wing and opposing object, and the returning force of the wing returning means. As a result, the rotor can be driven at a constant speed without being affected by change in the remaining energy level within a particular range. If a spring is the energy source, for example, the rotor speed can be governed to a constant speed throughout the greater part of the spring winding range and until just before the spring torque changes suddenly.

When an actuator, a generator, or other device that receives power from an energy storage means is disposed in the power transfer path from the energy storage means to the rotor, or after the rotor, or in path separate from the power transfer path to the rotor, the governor keeps the rotor speed constant, or more particularly keeps the energy supply rate of the energy storage means (such as how fast the spring unwinds) constant. As a result, while the operating speed of the actuator or generator varies in the short term, the total number of revolutions during a predetermined period averages out and operation of the actuator, such as a hammer, or generator can be controlled to a constant speed.

This governor affords the following effects.

The governor holds the operating speed of the actuator that is driven by the energy storage means constant by means of mechanical control instead of electronic control, therefore does not require a control circuit or sensor, and therefore reduces cost and occupies less space. Furthermore, because the governor is mechanical and does not require an electrical power supply, the governor can be used in products that do not have an electrical power source, including music boxes and mechanical timepieces having a repeater or striking mechanism. Furthermore, because the governor is mechanical and does not require an electrical power supply, using power produced by a generator-governor when used in an electronically controlled mechanical timepiece is unnecessary, and shortening the operating time of an electronically controlled mechanical timepiece as a result of increasing power consumption can be prevented.

The governor is a contactless governor that utilizes the resistance of fluid viscosity, therefore does not produce wear particles, and eliminates soiling the mechanism and deterioration. The appearance is therefore not impaired by wear particles, periodic maintenance involving disassembling and cleaning to remove wear particles, replacing parts due to part wear, and adjustment is required less frequently, and the maintenance cost can therefore be reduced.

Furthermore, using a contactless governor that utilizes the resistance of fluid viscosity prevents noise. The absence of noise affords enjoying the clear, pure tone of the striking mechanism when the governor is used in product for enjoying sound, such as a music box or a timepiece with a repeater or sonnerie mechanism.

Because the rotor rotates in only one direction, the damage and deterioration of colliding parts (such as the escape wheel and pallet stone, and the impulse pin and fork) that is observed with a reciprocating swiss lever escapement can be prevented even if the rotor 200 turns at high speed.

The governor can also be rendered thinly and easily incorporated into a wristwatch or other portable device.

Furthermore, air can be used as the viscous fluid, and because a housing or structure for sealing the viscous fluid is not required when air is used, the governor can be easily rendered compactly and loss from the seal between the housing and axle can be prevented.

The viscous load acting on the wings can be increased by providing the opposing member with surfaces opposing the surfaces of the wings. The brake power per volume ratio can therefore be increased, and the governor and a device incorporating the governor can be made smaller. The speed increasing ratio of the speed increasing wheel train can therefore be reduced and the number of wheels in the wheel train can be reduced accordingly, thereby reducing the parts count, reducing cost, and improving space efficiency.

The amount that the wings fly to the outside varies according to the centrifugal force and therefore the rotor speed. Therefore, by providing a gap radially to the rotor between the opposing object and the wings when the wings are at rest, the viscous resistance acting on the rotor changes greatly at a certain speed (the speed at which the wings begin to overlap the surface of the opposing object). The wings therefore repeat small variations in movement near the boundary to the opposing object (the inside circumference edge). Rotor speed can therefore be set by controlling this gap in the radial direction in addition to the acceleration rate, number of speed-increasing stages, and the output torque of the energy source.

More particularly, the timepiece of the invention is an electronically controlled mechanical timepiece having a mechanical energy source; a generator that is driven by the mechanical energy source to produce induced power and supply electrical energy; a rotation control device that is driven by electrical energy and controls the speed of generator rotation, and a time display device that operates in conjunction with generator rotation; an energy storage means for storing mechanical energy for operating the hammer; and a power transfer means for supplying energy from the energy storage means to the governor. The striking control means is driven by the mechanical energy supplied from the energy storage means to operate the hammer.

The mechanical energy source and energy storage means are both rendered by a barrel wheel with an internal hairspring.

When a bowl-shaped sound source is used in this electronically controlled mechanical timepiece, the tone of the bowl-shaped sound source can be heard more clearly and the echo effect of the gradually diminishing reverberations can be heard clearly because neither the timekeeping mechanism or the governor produce noise and there is no noise from an escapement as there is in a mechanical timepiece.

When a bowl-shaped sound source is used in an electronically controlled mechanical timepiece, separate barrel wheels can be provided (as a mechanical energy source) to drive the hands and (as an energy storage means) for operating the sound source, or a single barrel wheel can be used. For example, rotation of the barrel wheel connected to one end of the spring could be used to drive the hands, and the ratchet wheel that is connected to the other end of the spring and rotates in the opposite direction as the barrel wheel can be supplied to the governor and used for speed control. The operating time is shortened slightly in this case, but a smaller, thinner timepiece can be provided because a spring and barrel wheel can be eliminated.

The present invention enables disposing a bowl-shaped sound source inside a wristwatch or other small, wearable timepiece, and achieves a tone and reverberation not possible with timepieces according to the related art.

Other objects and attainments together with a fuller understanding of the invention will become apparent and appreciated by referring to the following description and claims taken in conjunction with the accompanying drawings.

DESCRIPTION OF EXEMPLARYS EMBODIMENTS

First Embodiment

A first embodiment of the present invention is described next.

Figure 1:
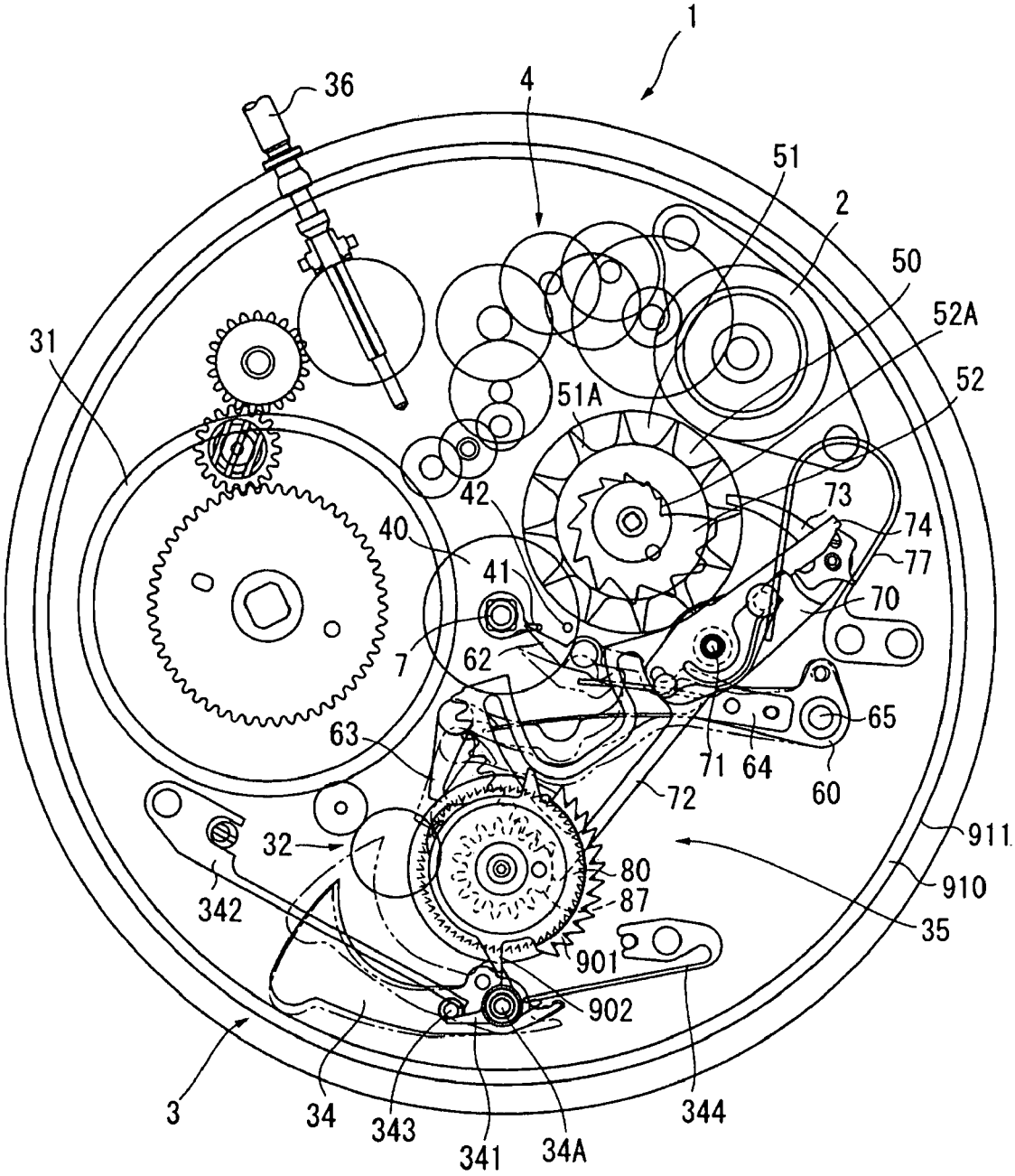
FIG. 1 is a plan view of a sonnerie mechanism in an electronically controlled mechanical timepiece according to a first embodiment of the invention.

FIG. 1 is a plan view of a timepiece 1 according to this first embodiment of the invention. The timepiece 1 has a sonnerie mechanism 3 rendered on the dial side of the base timepiece, and the governor 2 is used to operate the sonnerie mechanism.

The movement (timekeeping mechanism) for driving the hands of the timepiece 1 could be a movement for a mechanical timepiece, an analog quartz timepiece, or an electronically controlled mechanical timepiece. In a mechanical timepiece, however, the sound of the sonnerie mechanism is made difficult to hear by the ticking sound made by the governor, which has a balance, hairspring, pallet fork, and escape wheel, and by the sound of magnetostriction and gear teeth striking in an analog quartz timepiece. An electronically controlled mechanical timepiece, which produces less noise, is therefore preferably used.

* Arrangement of the Governor

The arrangement of the governor 2 is described next.

Figure 2A:
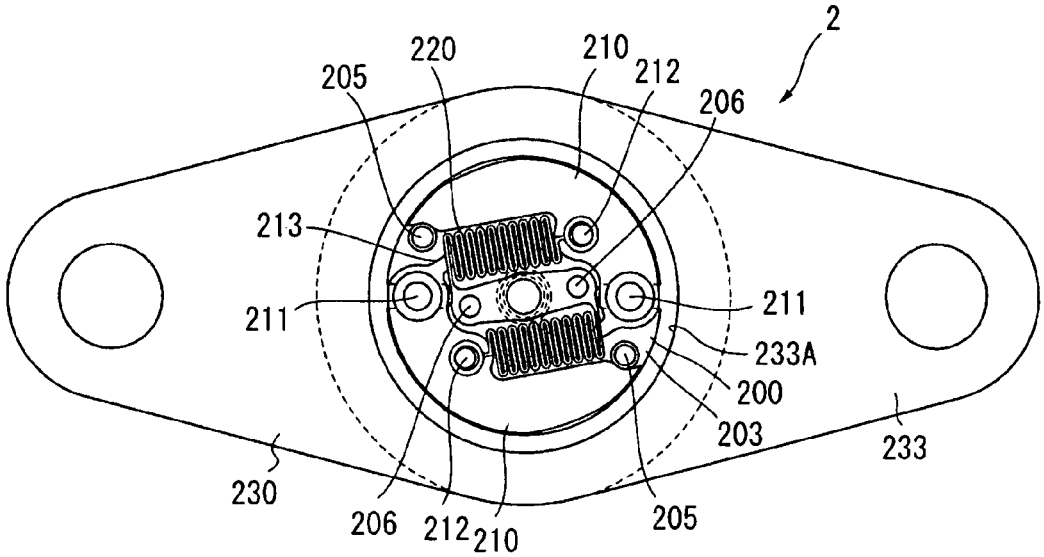
FIG. 2 is a plan view of the governor in the first embodiment.
Figure 2B:
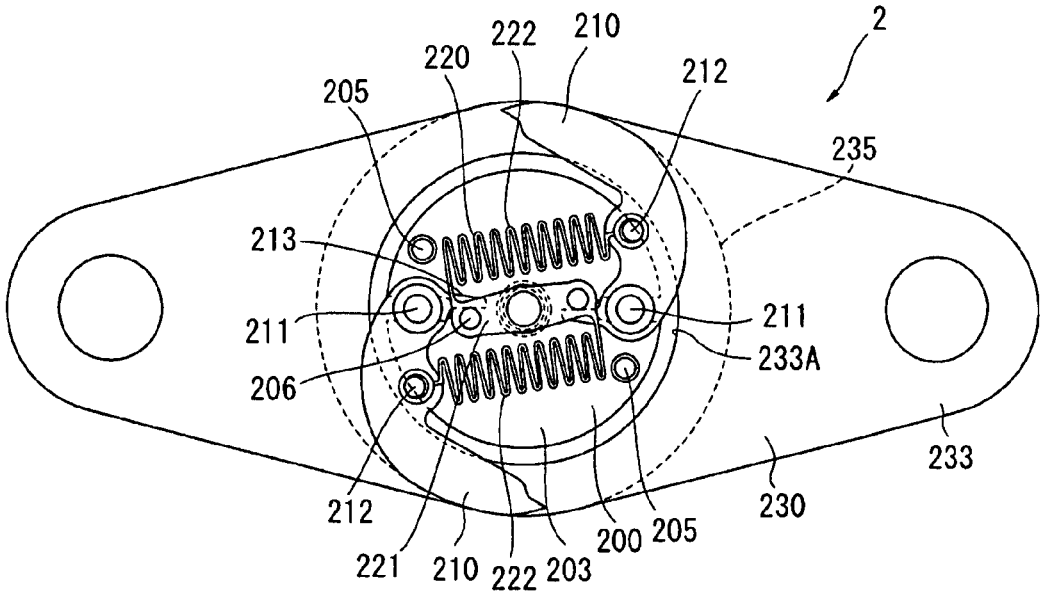
Figure 3:
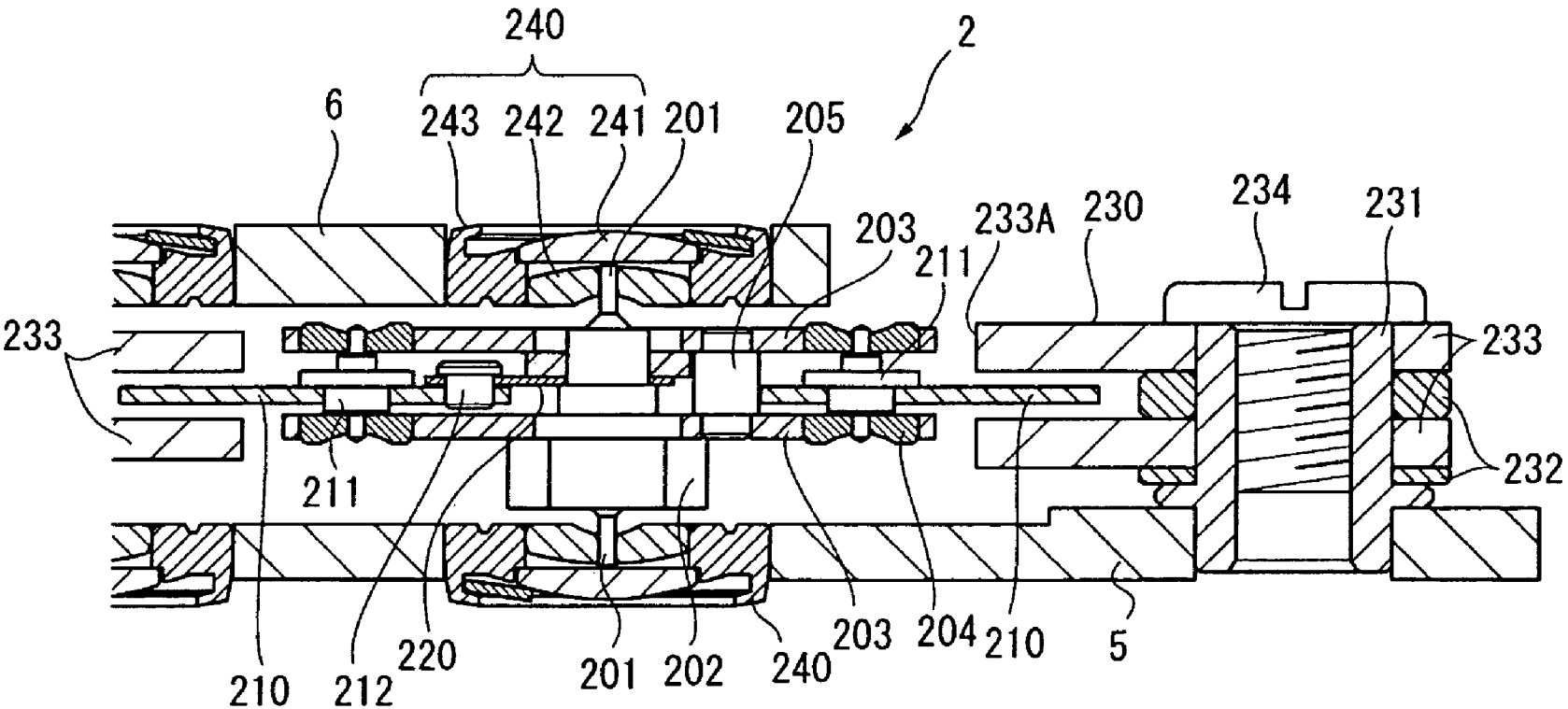
FIG. 3 is a section view of the governor in the first embodiment.

As shown in FIG. 2A, FIG. 2B, and FIG. 3, the governor 2 includes a rotor 200, two wings 210, a zigzag spring 220 that is a wing returning means, and opposing member 230.

The rotor 200 is located freely rotatably between the plate 5 and the train wheel bridge 6. More specifically, top and bottom tenon 201 parts of the rotor 200 are received by bearing units 240 assembled in the train wheel bridge 6 and plate 5. The bearing units 240 include jewels 241 and 242 made of ruby, for example, in the center, and a brass jewel guide 243 for guiding the jewels.

The rotor 200 has a rotor pinion 202 on which the tenons 201 are formed, and a wing guide plate 203 affixed to the rotor pinion 202.

The rotor pinion 202 is a small wheel made of hardened steel. The rotor pinion 202 meshes with a wheel in the drive power transfer wheel train 4, which is the power transfer means. The drive power transfer wheel train 4 is a speed-increasing wheel train, and engages the barrel wheel 31, which has an internal spring. The rotor 200 is turned by mechanical energy transferred from the barrel wheel 31 through the drive power transfer wheel train 4.

A pair of wing guide plates 203 is affixed with a specific gap therebetween to a part of the rotor pinion 202. The wing guide plate 203 disposed proximally to the rotor pinion 202 is press fit and secured to a part of the rotor pinion 202, and the other wing guide plate 203 is attached to the rotor pinion 202 by means of the press-fit wing guide plate 203 and a wing locking stud 205. The wing guide plates 203 are thin plates of stainless steel or brass, and are circular in plan view.

Wing stud jewels 204 made of ruby or other hard stone are press fit into the wing guide plates 203, and the ends of the steel wing locking stud 205 and steel spring catch stud 206 are press fit into both wing guide plates 203. The wing stud jewels 204 are located point symmetrically to the rotor pinion 202.

The axles of the steel wing pins 211, which are press fit to the wings 210, are inserted to the wing stud jewels 204. The wing stud jewels 204 are appropriately lubricated so that the wing pin 211 can rotate smoothly.

A zigzag spring 220 is attached to spring catch studs 206.

The zigzag spring 220 is formed by shaping thin stainless steel plate, and includes a spring positioning part 221 disposed in the middle, and a pair of zigzag spring parts 222 formed in a zigzag extending from the opposite ends of the spring positioning part 221.

The zigzag spring 220 is attached to the wing guide plates 203 so that the zigzag spring 220 does not rotate by fitting the two holes formed in the spring positioning part 221 over the spring catch studs 206. The rotor pinion 202 passes through the hole in the center of the spring positioning part 221.

The wings 210 are thin stainless steel pieces that are substantially crescent shaped in plan view, and are disposed rotatably on wing pins 211. A steel wing spring catch pin 212 is press fit to each wing 210 between the wing pin 211 and the distal end of the wing 210 at a position offset towards the wing pin 211 from the center of gravity of the wing 210. A ring part rendered at the distal end of the zigzag spring part 222 of the zigzag spring 220 is caught on the wing spring catch pin 212. A flange is formed on the distal end of the wing spring catch pin 212 to prevent the zigzag spring 220 from slipping off. The zigzag spring 220 thus pulls the distal end of the wings 210 towards the rotational axis (rotor pinion 202) of the rotor 200.

When the rotor 200 is stopped, the force of the zigzag spring 220 pulls the wings 210 towards the center of the rotor 200 so that the distal ends of the wings 210 are against the wing locking studs 205.

When the rotor 200 turns, centrifugal force corresponding to the speed of rotation causes the wings 210 to rotate around the wing pin 211 against the zigzag spring 220 and move to the outside (to the outside circumference side radially to the rotor 200) as shown in FIG. 2B.

A finger 213 is disposed to each wing 210 near the wing pin 211, and movement of the wings 210 to the outside is limited to the position (angle) where this finger 213 contacts the spring catch stud 206. The finger 213 and spring catch stud 206 render an excessive wing movement prevention means in this embodiment of the invention.

When the rotor 200 speed decreases, the centrifugal force acting on the wings 210 also drops according to the decrease in rotational speed, and the zigzag spring 220 therefore pulls the wings 210 a corresponding amount back towards the rotor 200.

The wings 210 are axially supported by the wing stud jewels 204 disposed point symmetrically to the rotor pinion 202, and are thus attached at a position balanced to the rotor 200.

The opposing member 230 has a cylindrical support member 231 that is press fit and fastened to the plate 5, two opposing plates 233 disposed to the flange of the support member 231 with intervening spacers 232, and a set screw 234 that screws into the support member 231 and holds the opposing plates 233 between the screw 234 and the support member 231.

The distance between the opposing plates 233 is determined by the thickness of the spacer 232 between the opposing plates 233. Spacers 232 of various thicknesses are prepared in this embodiment of the invention, and the distance between the opposing plates 233 can be set appropriately during manufacture or later by selectively inserting the right spacer 232.

The rotor 200 is disposed inside an opening 233A formed in the opposing plates 233. This opening 233A in the opposing plate 233 is concentric to the axle of the rotor 200.

When the wings 210 move to the outside due to centrifugal force, the wings 210 are located in the gap between the opposing plates 233. The wings 210 are disposed substantially in the center of the gap between the opposing plates 233, and the gap between the wings 210 and each of the opposing plates 233 is substantially equal.

The wings 210 in this embodiment of the invention are shaped as shown in FIG. 2 so that when the distal ends contact the wing locking stud 205 the outside edge of the wings 210 is inside the outside circumference of the wing guide plate 203 and the outside edges of the wings 210 do not protrude from the wing guide plate 203.

The wings 210 are also shaped so that when centrifugal force causes the wings 210 to swing out to the maximum outside position where the fingers 213 on the wings 210 contact the spring catch studs 206, part of the outside profile of the wing 210 is concentric to the opening 233A. More specifically, the wings 210 are shaped so that part of the outside edge of the wings 210 is superimposed on an imaginary line 235 concentric to the opening 233A as shown in FIG. 2B.

* Governor Operation

A governor 2 arranged as described above operates as follows to control the speed.

When the rotor 200 is turned by means of the intervening drive power transfer wheel train 4, centrifugal force acts on the wings 210 and causes the wings 210 to fly to the outside of the wing guide plate 203 and enter the space between the opposing plates 233. Because of the small gap between the surfaces of the wings 210 and the opposing surfaces of the opposing plates 233, the wings 210 are subject to greater resistance due to air viscosity than before entering the gap between the opposing plates 233. This resistance due to air viscosity causes the speed of the rotor 200 to drop and the centrifugal force to decrease so that the wings 210 which had flown to the outside of the wing guide plate 203 are pulled back towards the rotor 200 by the zigzag spring 220.

When the rotor 200 speed drops and the wings 210 are pulled back to the wing guide plate 203 from between the opposing plates 233, the resistance of air viscosity on the wings 210 decreases, the rotor 200 therefore accelerates again, and the wings 210 again fly outside of the wing guide plate 203 and enter the gap between the opposing plates 233. As this behavior repeats, the rotor 200 is held at a substantially constant speed.

The speed of the rotor is also affected by variation in the meshing efficiency of the gears in the drive power transfer wheel train 4 and variation in the operation of the device driven by the rotor (the sonnerie mechanism in this embodiment of the invention). In any case, however, centrifugal force corresponding to the rotor speed acts on the wings 210, the distance the wings fly out varies according to the speed, and the speed of the rotor 200, that is, the operating speed of the device being driven, is held substantially constant.

* Sonnerie Mechanism

The sonnerie mechanism 3, the operating speed of which is regulated by the governor 2 of this embodiment of the invention, is described next.

Except for the use of a bowl-shaped sound source instead of a gong as the sound source, the basic arrangement of a sonnerie mechanism is known from the literature, and detailed description of the sonnerie mechanism is therefore omitted or simplified below.

The arrangement of a sonnerie mechanism according to the related art is described, for example, in "A Guide to Complicated Watches" by Francois Lecoultre, pages 159 to 179.

The sonnerie mechanism 3 is located on the dial side of the movement in the timepiece 1, and as shown in FIG. 1 includes a barrel wheel 31 with an internal spring that is the energy storage means of the sonnerie mechanism, the drive power transfer wheel train 4 as a speed-increasing wheel train conveying torque from the barrel wheel 31 to the governor 2, a bowl-shaped sound source 910 for producing sound, a hammer 34 for striking the bowl-shaped sound source 910, and a striking control means 35 for causing the hammer 34 to operate and strike a number of times corresponding to the time.

The barrel wheel 31 is provided specifically for the sonnerie mechanism and is separate from the barrel wheel that is used to drive the hands of the timepiece 1, and is rendered so that the internal spring can be tightened by turning the crown 36 with the stem 36A at step 0.

The bowl-shaped sound source 910 is a metal bell that is disposed along the outside circumference of the sonnerie mechanism 3 (the outside circumference of the timepiece movement) and fastened to the movement. How the sound source 910 is attached is described in detail below.

The hammer 34 is also made of hardened steel and is disposed to strike the bowl-shaped sound source 910. The hammer 34 is operated by a hammer trip 341 that is disposed to pivot freely on the hammer 34 support pin 34A, and a hammer spring 342 that urges the hammer 34 toward the bowl-shaped sound source 910. More specifically, the hammer spring 342 contacts the spring pin 343 of the hammer 34 and urges the hammer 34 to pivot counterclockwise as seen in FIG. 1 around the support pin 34A. The hammer trip 341 also contacts the spring pin 343. When the sonnerie mechanism 3 is not operating, the hammer trip 341 is held in the position shown in FIG. 1 by a pawl 902 described further below so that the hammer 34 is also at rest at a position separated from the bowl-shaped sound source 910. The hammer trip 341 is urged in the clockwise direction as seen in FIG. 1 by a hammer trip spring 344.

The striking control means 35 includes a screw nut 40, a snail wheel 50, a release lever 60, an hour repeating rack 70, and a center wheel 80.

The hour repeating rack 70 and center wheel 80 are the parts of this sonnerie mechanism that feature improvements over the sonnerie mechanism of the related art and are therefore described in detail below. Other parts of the sonnerie mechanism are known from the literature, and further description thereof is omitted below.

The screw nut 40 rotates in unison with the cannon pinion 7 that drives the hands, and drives the release lever 60 by means of a stud 41.

More specifically, a chamferred portion is formed on the outside of the cannon pinion 7, and a screw nut 40 with a center ratchet hole is inserted from the dial side. The screw nut 40 therefore turns in unison with the cannon pinion 7 (second wheel=minute hand).

The stud 41 on the outside part of the screw nut 40 contacts the release lever 60 slightly before the base movement indicates the hour (the minute hand points to twelve), and rotates the release lever 60 counterclockwise as seen in FIG. 1.

A pin 42 also protrudes from the disk portion of the screw nut 40.

The snail wheel 50 includes a star wheel 51 with twelve teeth 51A, and a snail plate 52 with twelve faces 52A each with a sequentially different length from the axis of rotation. If L1 is the length of the face that is nearest the axis of rotation, L2 is the length of the face that is next closest to the axis of rotation, L3 is the length of the third shortest face, lengths L1, L2, and L3 are measured from the center of rotation, and ΔL is the difference between L1 and L2, then the length L2=L1+ΔL, and the length L3=L1+2×ΔL.

In other words, if the length of each face 52A is sequentially denoted L1 to L12 from shortest to longest, length Ln=L1+(n−1)×ΔL (where n ranges from 1 to 12), and the length of each face 52A is set to the length sequentially incremented for each ΔL.

The snail wheel 50 rotates 1/12 revolution per hour as a result of the pin 42 on the screw nut 40 engaging the teeth 51A of the star wheel 51.

Figure 4:
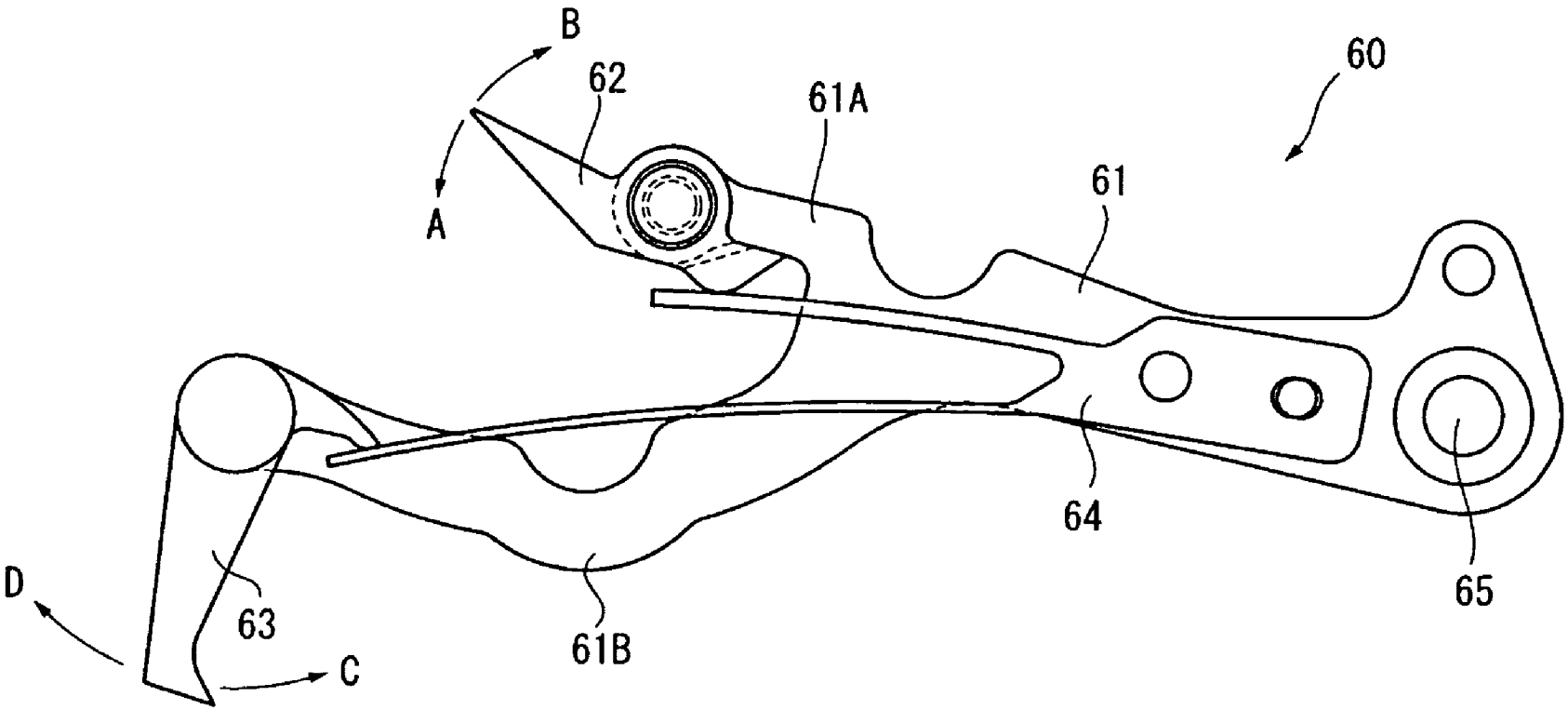
FIG. 4 is a plan view of the release lever of the sonnerie mechanism.

As shown in FIG. 4, the release lever 60 includes a substantially Y-shaped main lever 61, a beak 62 affixed to the distal end of one arm 61A of the main lever 61, a release lever click 63 affixed to the distal end of the other arm 61B of the main lever 61, and a release lever spring 64 that is engaged by the release lever click 63.

The release lever 60 is disposed freely rotatably to the plate 5 by means of an axle 65, and is rotated counterclockwise as seen in FIG. 1 in conjunction with rotation of the screw nut 40.

The beak 62 is attached freely rotatably to the main lever 61, and is urged to rotate counterclockwise (in the direction of arrow A) as seen in FIG. 4 by the release lever spring 64. This rotation is limited to the position where the beak 62 contacts the main lever 61 as shown in FIG. 4.

When force causing the beak 62 to rotate clockwise (in the direction of arrow B) in FIG. 4 is applied, such as by turning the crown 36 to move the minute hand counterclockwise, the beak 62 turns in the direction of arrow B and is then returned to the original position by the urging force of the release lever spring 64. This prevents damage to the beak 62 and the release lever 60.

The release lever click 63 is urged to rotate counterclockwise (in the direction of arrow C) in FIG. 4 by the release lever spring 64, and engages the triangular teeth 821 of the release ratchet 82 of the center wheel 80 as further described below.

When the release lever 60 turns counterclockwise, the release lever click 63 pushes the triangular teeth 821 of the release ratchet 82 and causes the release ratchet 82 to rotate counterclockwise.

The hour repeating rack 70 (HRR) converts the current time denoted by the snail wheel 50 to the strokes corresponding to the number of times the bowl-shaped sound source 910 is struck, and stops the barrel wheel 31 when the sonnerie mechanism 3 is stopped.

Figure 5:
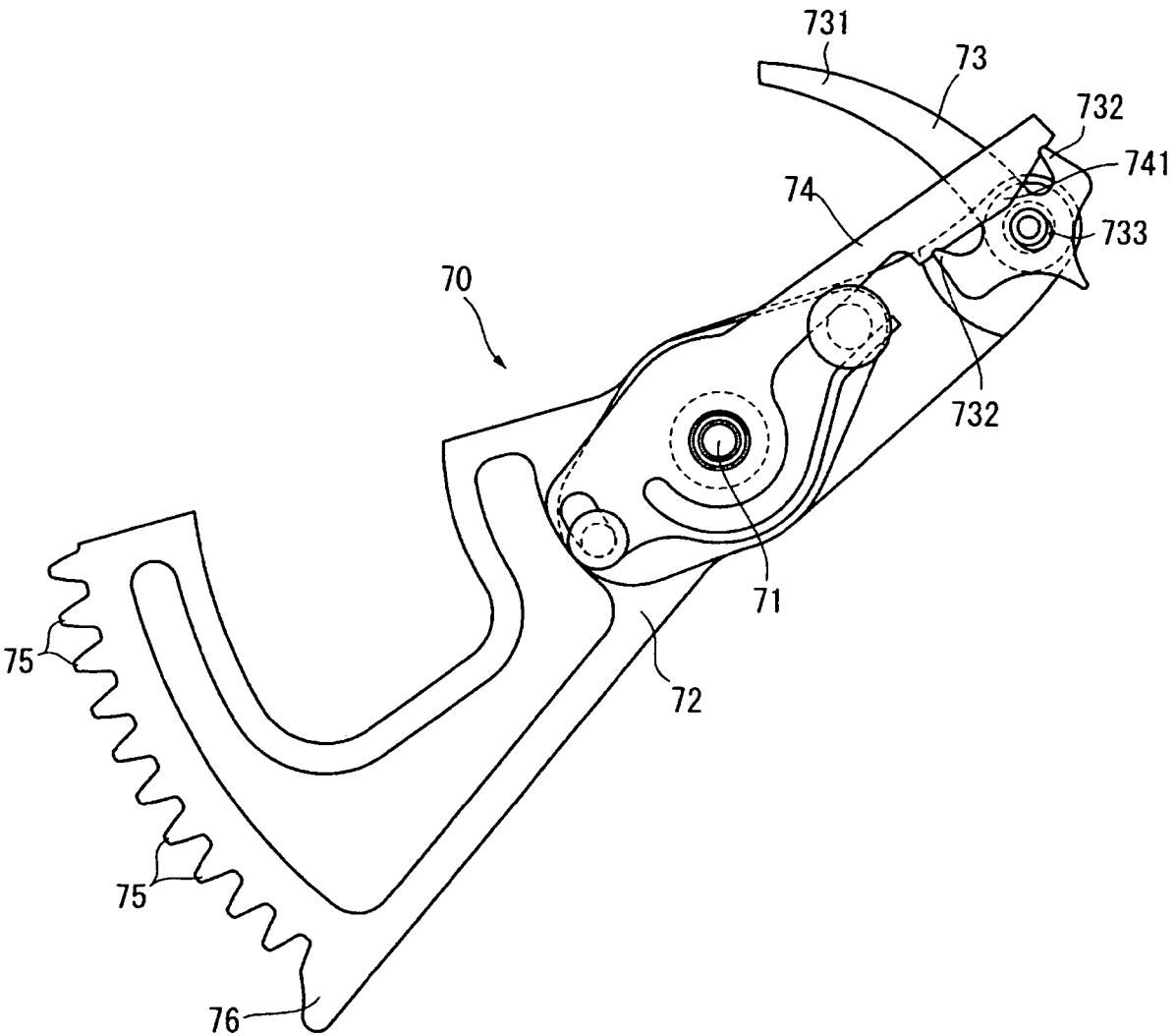
FIG. 5 is a plan view of the hour repeating rack in the sonnerie mechanism.

As shown in FIG. 5, the hour repeating rack 70 has an axle 71 supported freely rotatably between the plate 5 and train wheel bridge 6, a main rack 72 that is press fit to the axle 71, an hour repeating rack click 73 attached freely rotatably to the main rack 72, and an hour repeating rack click spring 74 that is guided by the axle 71 and urges the hour repeating rack click 73.

The main rack 72 has teeth 75 arranged in an arc centered on the axle 71. A stop 76 disposed at an end of this arc portion contacts and limits rotation of the center wheel 80 as further described below.

The hour repeating rack click 73 has a basically T-shaped terminal part 731 (time-reading terminal) for touching the faces 52A of the snail wheel 50, and two engaging parts 732 for engaging the hour repeating rack click spring 74. The hour repeating rack click 73 is affixed freely rotatably to the main rack 72 by fitting an oblong hole 733 (tracking hole) formed in the hour repeating rack click 73 onto a pin press fit in the main rack 72.

Figure 6:
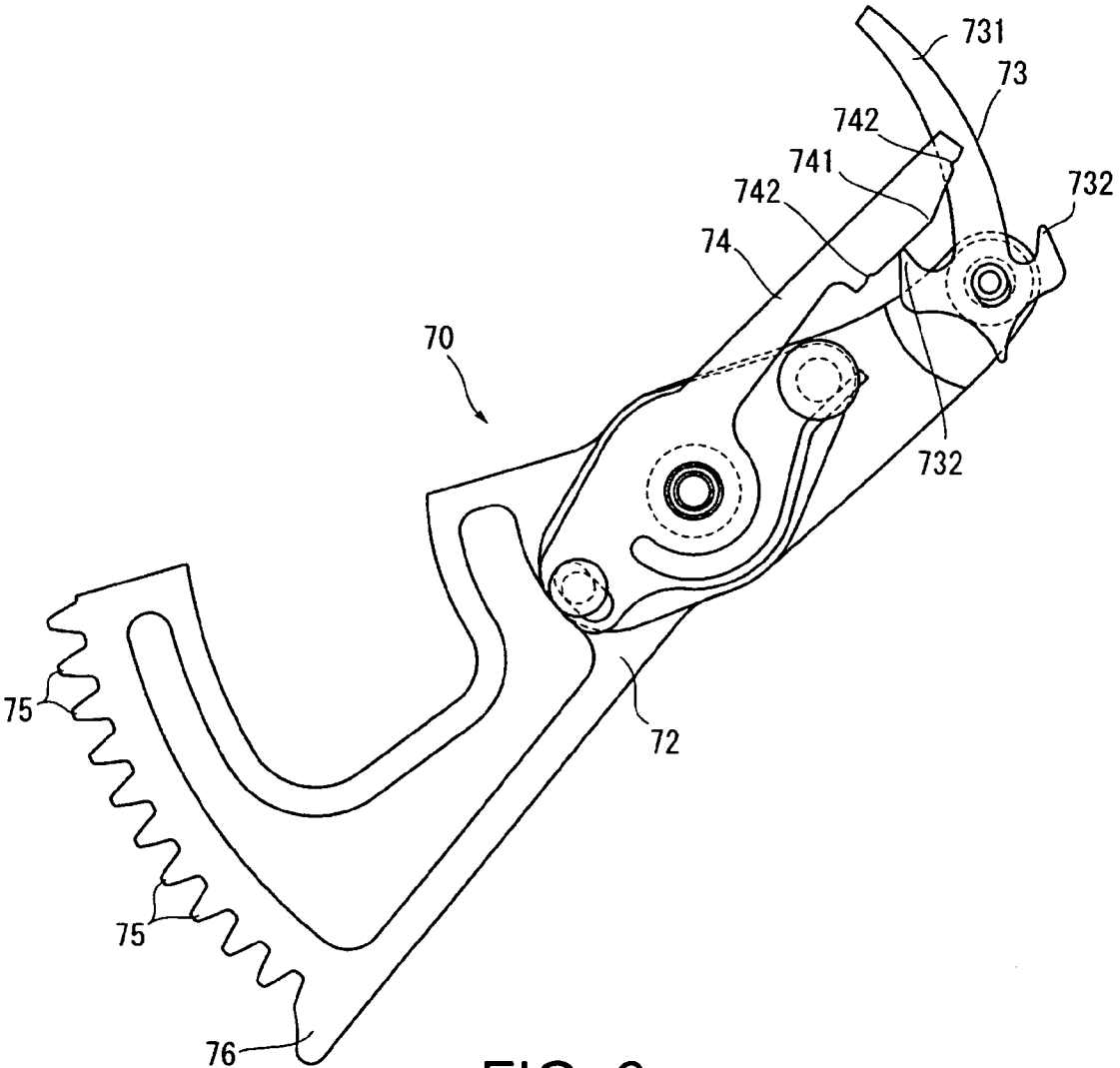
FIG. 6 is a plan view showing rotation of the hour repeating rack click in the hour repeating rack of the sonnerie mechanism.

As shown in FIG. 6, the hour repeating rack click spring 74 is a spring with a triangular tooth 741, and small notches 742 formed at two locations on the sloped sides of this triangular tooth 741. When the engaging parts 732 fit into these notches 742, the hour repeating rack click 73 is in the resting position.

When the hour repeating rack click 73 is in contact with a face 52A on the snail wheel 50 and the hands are adjusted, causing the snail wheel 50 to turn and the snail plate 52 to contact the side of the hour repeating rack click 73, the engaging parts 732 separate from the notches 742 and the hour repeating rack click 73 can turn so that the hour repeating rack click 73 is not damaged.

When contact between the snail wheel 50 and the hour repeating rack click 73 is released, the engaging parts 732 are guided by the slopes of the triangular tooth 741 and the hour repeating rack click 73 is automatically returned to the resting position with the engaging parts 732 fit in the notches 742.

An hour repeating rack spring 77 fastened on the plate 5 urges the hour repeating rack 70 to move counterclockwise as seen in FIG. 1 on the axle 71.

Figure 7:
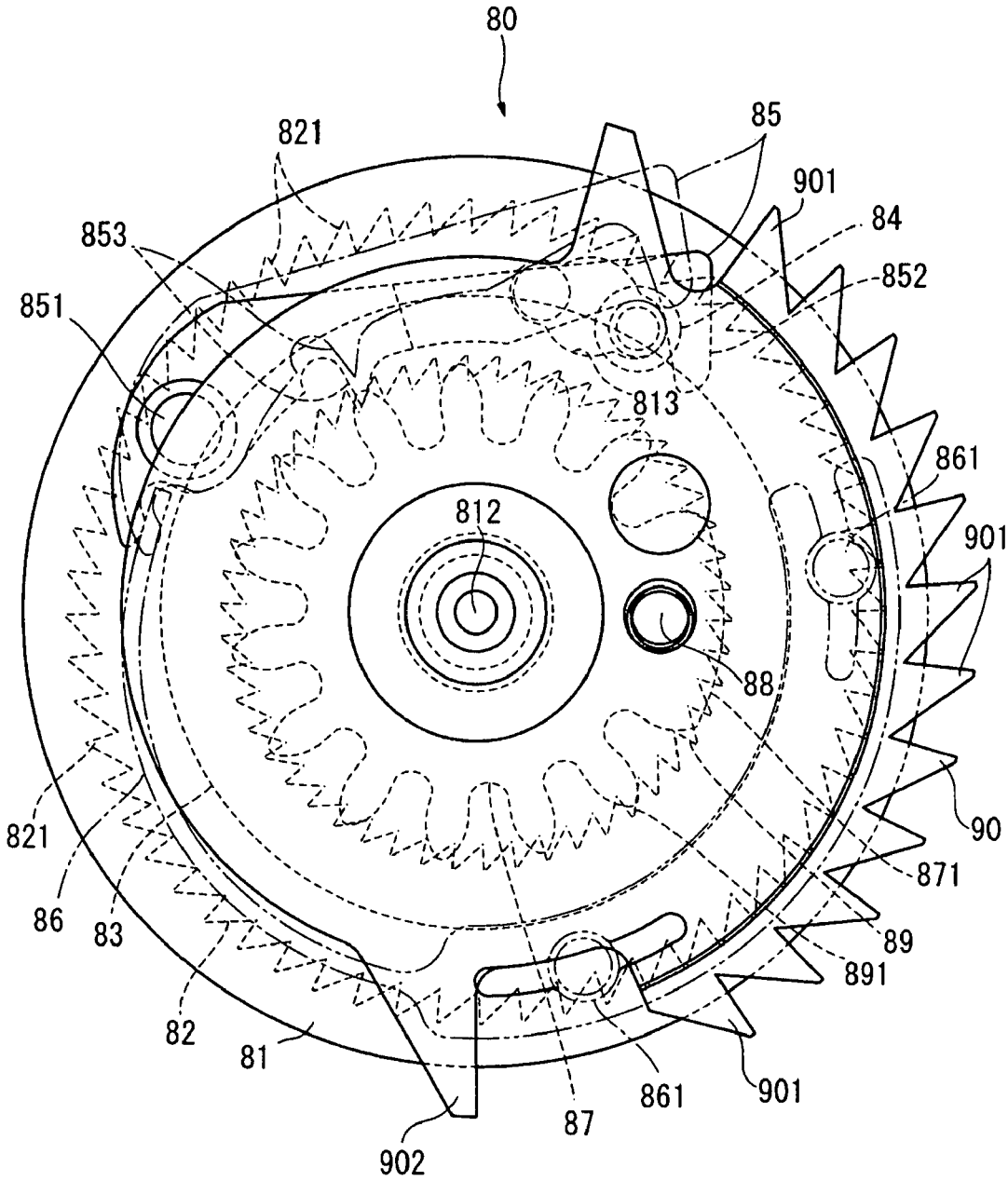
FIG. 7 is a plan view of the center wheel of the sonnerie mechanism.
Figure 8:
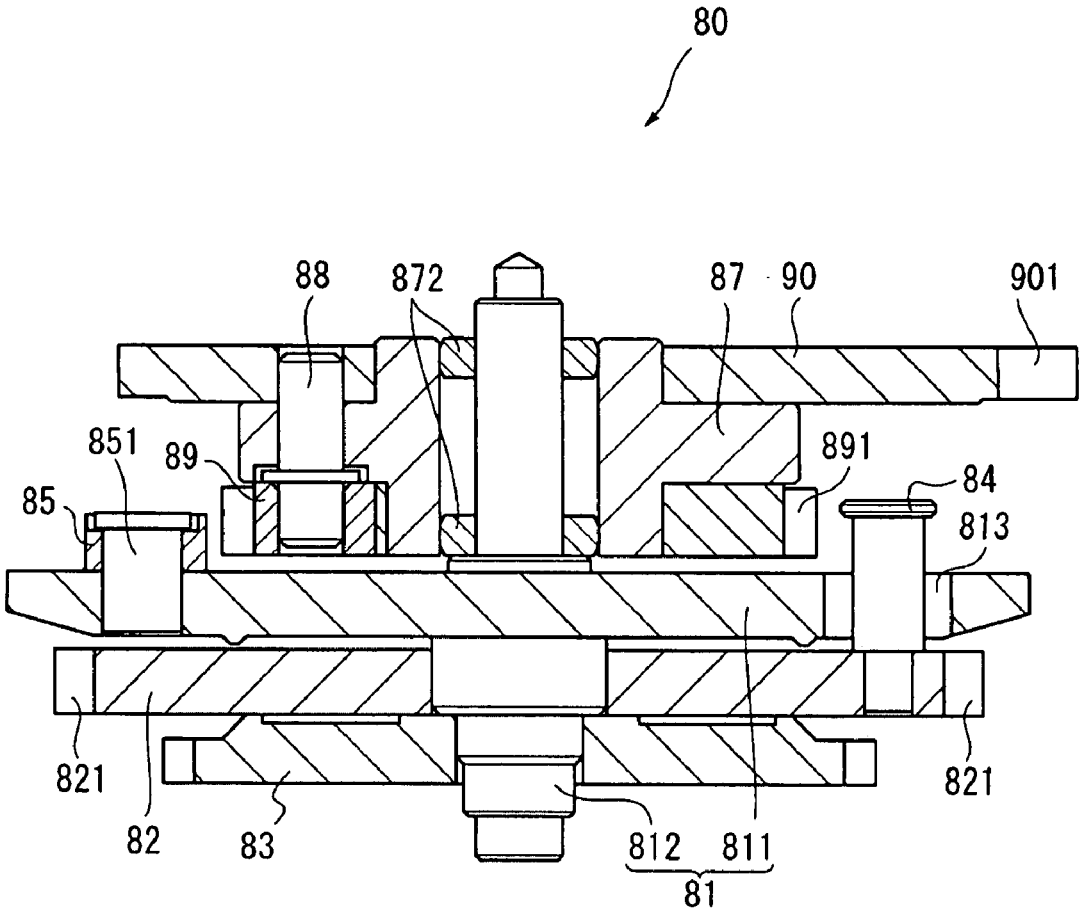
FIG. 8 is a section view of the center wheel of the sonnerie mechanism.
Figure 9:
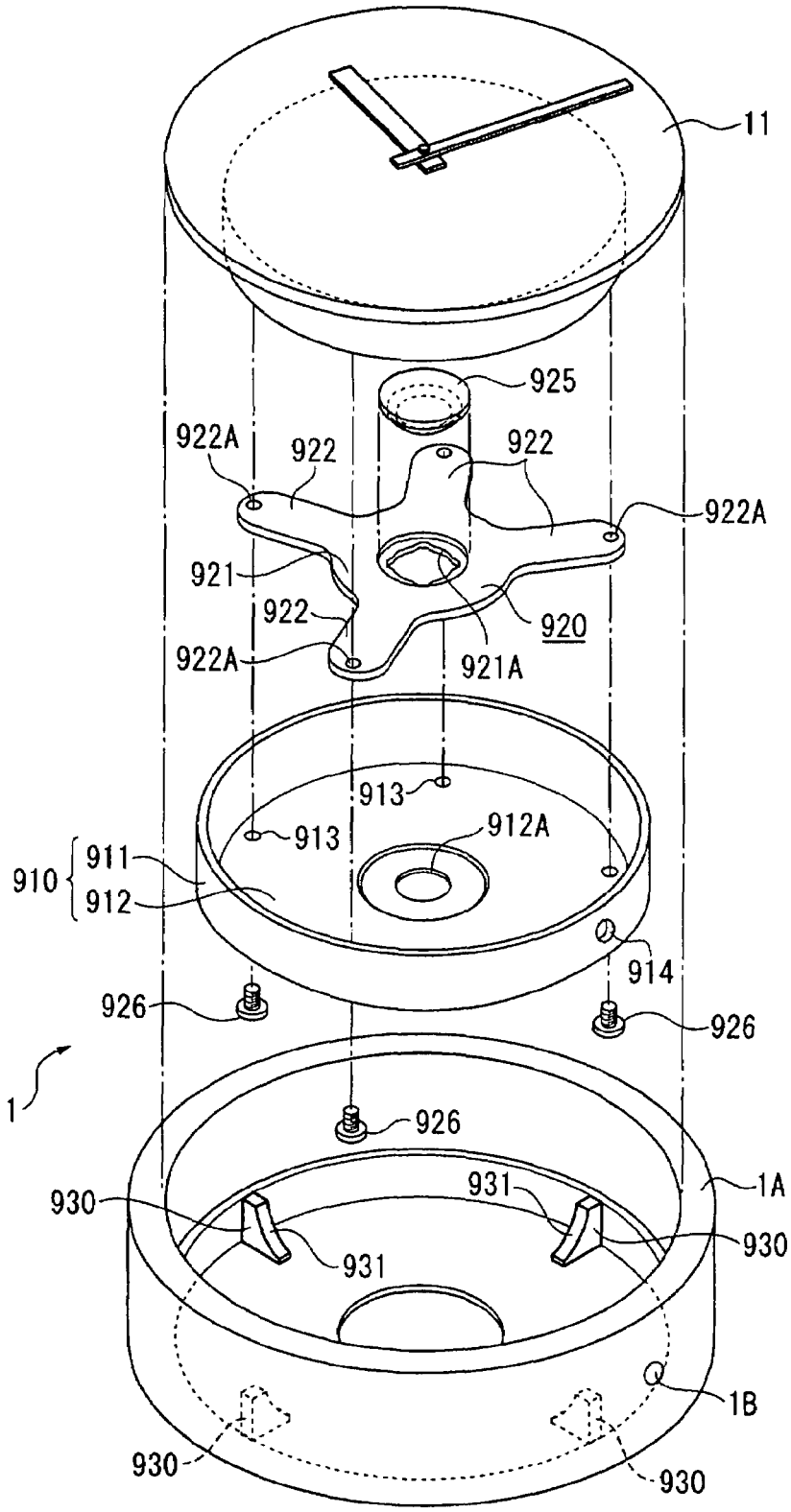
FIG. 9 is an exploded oblique view showing the fastening assembly of the bowl-shaped sound source in the first embodiment of the invention.
Figure 10:
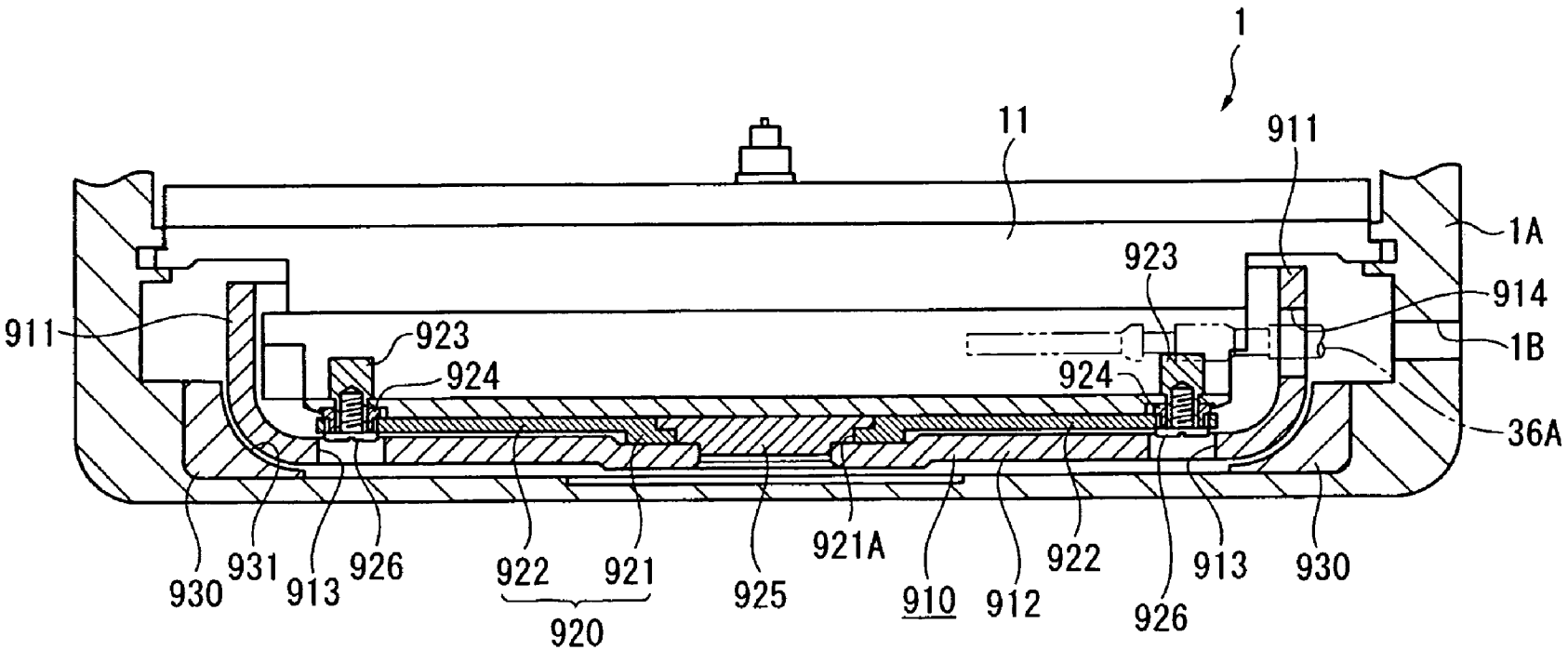
FIG. 10 is a section view of the fastening assembly of the bowl-shaped sound source in the first embodiment of the invention.
Figure 11:
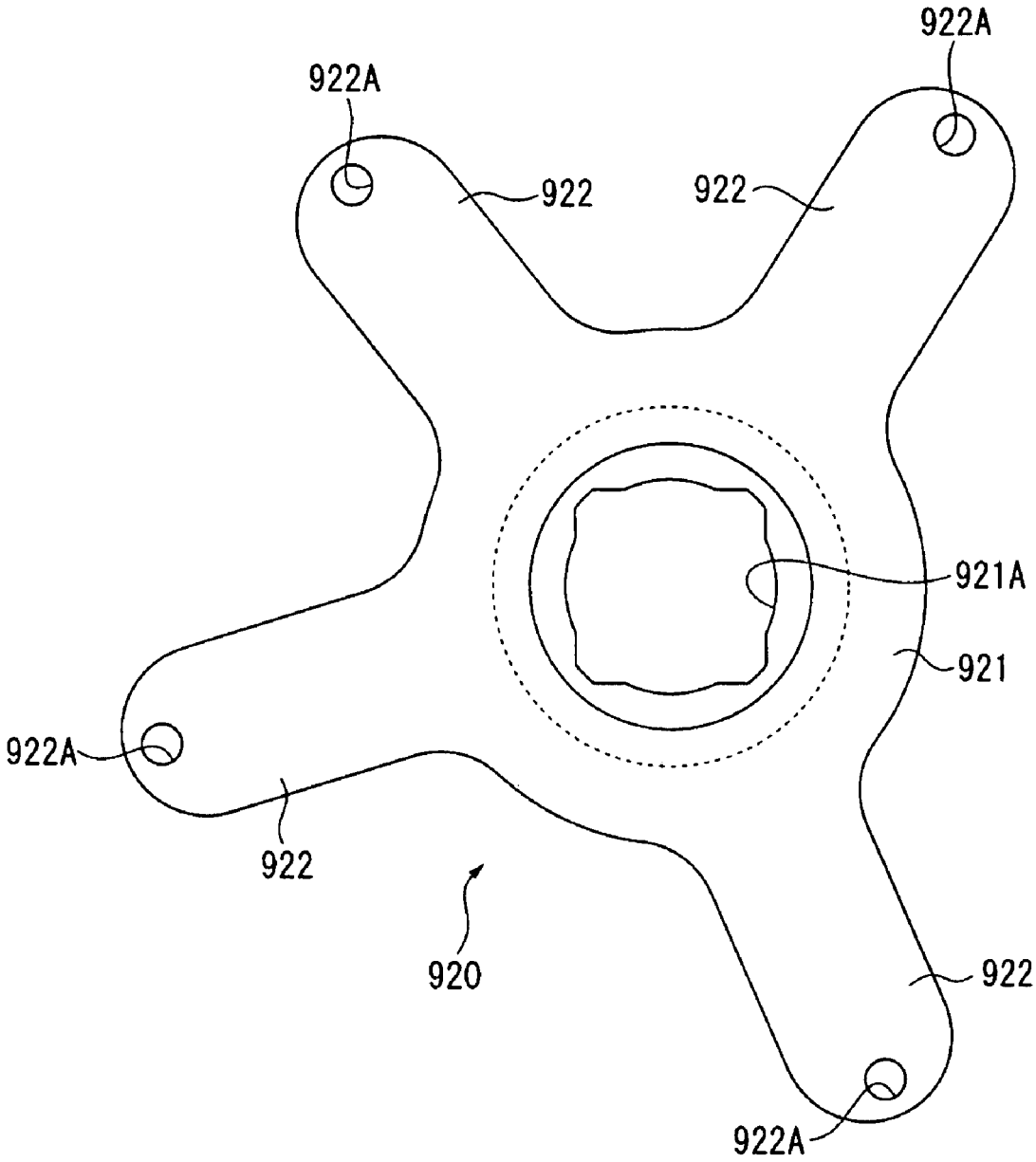
FIG. 11 is a plan view of sound source fastening plate in the first embodiment of the invention.

As shown in FIG. 7 and FIG. 8, the center wheel 80 has a driving roller 81, a release ratchet 82, a center wheel pinion 83, a release pin 84, a center wheel release click 85, a center wheel release click spring 86, a gathering rack pinion 87, a gathering rack pinion positioning pin 88, a driving ratchet 89, and an hour ratchet 90.

The driving roller 81 includes a disk 811 and an axle 812. The axle 812 is supported freely rotatably on the plate 5 and train wheel bridge 6.

The release ratchet 82 is disposed on the plate 5 side of the driving roller 81, and is inserted freely rotatably on the axle 812. This release ratchet 82 is substantially disk shaped and has triangular teeth 821 around the outside for engaging the release lever click 63 of the release lever 60.

After assembling the release ratchet 82 to the axle, the center wheel pinion 83 is press fit onto the axle 812 from the plate 5 side. The center wheel pinion 83 is a circular gear that meshes with the speed increasing wheel train 32 for transferring rotation from the barrel wheel 31 as shown in FIG. 1.

The release pin 84 is press fit to the release ratchet 82 and is disposed passing through a hole 813 formed in the disk 811 of the driving roller 81. This hole 813 is an oblong hole of a specific length in the circumferential direction of the disk 811.

The center wheel release click 85 is affixed freely rotatably to the disk 811 of the driving roller 81 by a flanged pin 851. The center wheel release click 85 has an engaging part 852 for engaging the release pin 84, and a pawl 853 for engaging the triangular teeth 891 of the driving ratchet 89 as further described below.

The center wheel release click spring 86 is fixed on the disk 811 of the driving roller 81 by a pin 861. The distal end of the center wheel release click spring 86 engages the center wheel release click 85 and urges the center wheel release click 85 to rotate clockwise on the flanged pin 851.

The gathering rack pinion 87 has teeth around the outside and a toothless portion 871 where no teeth are formed. A jewel 872 is press fit into a through-hole formed in the center of the gathering rack pinion 87. The gathering rack pinion 87 is fit onto the axle 812 from the train wheel bridge 6 side of the disk 811, and is supported freely rotatably by the axle 812.

The gathering rack pinion positioning pin 88 is press fit to the gathering rack pinion 87 and is also inserted to the driving ratchet 89 and hour ratchet 90. The gathering rack pinion positioning pin 88 therefore determines the position of the gathering rack pinion 87, driving ratchet 89, and the hour ratchet 90.

The driving ratchet 89 is located on the plate 5 side of the gathering rack pinion 87, and is press fit to and positioned by the gathering rack pinion positioning pin 88. The entire outside circumference of the driving ratchet 89 is populated by triangular teeth 891. The pawl 853 of the center wheel release click 85 meshes with these triangular teeth 891.

The hour ratchet 90 is located on the train wheel bridge 6 side of the gathering rack pinion 87, and is press fit to and positioned by the gathering rack pinion positioning pin 88. Twelve triangular teeth 901 are formed on part of the outside circumference of the hour ratchet 90.

The hour ratchet 90 also has a pawl 902 for stopping the hammer to prevent the hammer 34 from operating when the sonnerie mechanism 3 is stopped.

* Securing the Bowl-Shaped Sound Source

The arrangement for affixing the bowl-shaped sound source 910 to the movement 11 is described next with reference to FIG. 9 to FIG. 12.

A bowl-shaped sound source 910 such as used in wind chimes, temple bells, the chimes in traditional Japanese lunar calendar clocks, and the chimes in alarm clocks produce sound primarily by means of vibration in the side wall 911 part. As a result, the bowl-shaped sound source 910 cannot be fastened at the side wall 911, and must be attached at the center of the bottom 912.

As we studied ways to fasten the bowl-shaped sound source 910, we also discovered that even if the bowl-shaped sound source 910 is attached at the center of the bottom 912, vibration of the bowl-shaped sound source 910 is restricted and the reverberations become short if the bottom 912 is fixed too tightly.

If the bowl-shaped sound source 910 is disposed in a wristwatch or similarly small timepiece, the movement 11 must be located inside the bowl-shaped sound source 910 in order to reduce the size of the timepiece. If a movement 11 for an analog timepiece is used, the center of the bottom 912 of the bowl-shaped sound source 910 seen in plan view is at the same position as the shaft for driving the hands of the analog timepiece, and a screw or other means for fastening the bowl-shaped sound source 910 cannot be disposed where the drive shaft for the hands of the movement 11 is located.

This embodiment of the invention therefore uses a novel construction to indirectly secure the bowl-shaped sound source 910 using an intervening sound source mounting plate 920 as the sound source mounting member of the accompanying claims instead of securing the bowl-shaped sound source 910 directly to the movement 11.

The sound source mounting plate 920 is a metal member having a fixed portion 921 that is attached to the center of the bottom 912 of the bowl-shaped sound source 910, and a plurality of fixed arms 922 extending from the fixed portion 921 towards the outside circumference of the movement 11.

A shouldered hole 921A is formed in the fixed portion 921. A sound source fastening pin 925 is then inserted from this hole 921A through a corresponding hole 912A rendered in the center of the bottom 912 of the bowl-shaped sound source 910, and the distal end of the sound source fastening pin 925 is crimped to secure the sound source mounting plate 920 in the center of the bottom 912 of the bowl-shaped sound source 910.

There are four fixed arms 922 in this embodiment of the invention. The number of fixed arms 922 is not limited to four, but there are preferably three or more fixed arms 922 in order to easily set and hold the plane position of the bowl-shaped sound source 910.

A hole 922A for fastening the movement 11 is formed in the distal end of each of the fixed arms 922.

Figure 12:
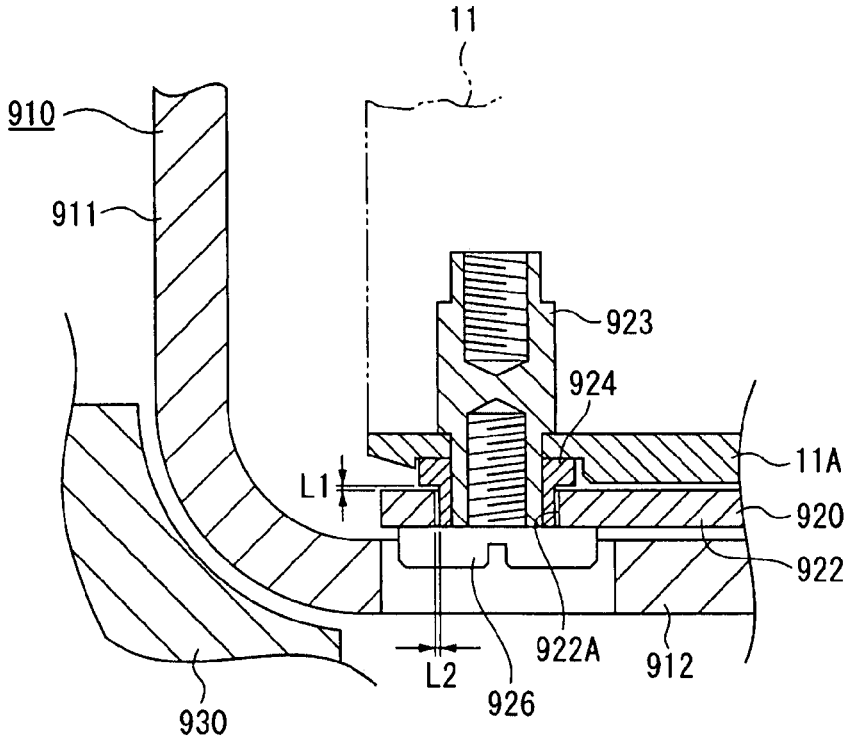
FIG. 12 is an enlarged section view showing a main part of the fastening assembly of the bowl-shaped sound source in the first embodiment of the invention.

As shown enlarged in FIG. 12, a pin 923 disposed to the movement 11, and a sound source mounting plate spacer 924 are inserted to each of the holes 922A. The sound source mounting plate spacer 924 is a cylindrical member with an end flange.

The sound source mounting plate spacer 924 is fit over the pin 923 and into the hole 922A in the sound source mounting plate 920, and a set screw 926 is then screwed into the threaded hole in the pin 923 to attach the sound source mounting plate 920 to the timepiece movement bridge 11A of the movement 11.

If the bottom 912 of the bowl-shaped sound source 910 is on the bottom and the movement 11 is on the top so that the bowl-shaped sound source 910 is hanging freely of its own weight, there is a gap L1 between the top of the sound source mounting plate 920 and the bottom of the flange part of the sound source mounting plate spacer 924, and a gap L2 between the inside circumference of the holes 922A and the sound source mounting plate spacer 924.

These gaps L1 and L2 are preferably approximately 0.01 mm to 0.1 mm. If these gaps are too large, the bowl-shaped sound source 910 may move too much when the bowl-shaped sound source 910 is struck by the hammer 34. If this happens, the distance between the hammer 34 and the side wall 911 of the bowl-shaped sound source 910 will change, the striking force of the hammer 34 on the bowl-shaped sound source 910 will change, and the tone will therefore also change.

Conversely, if the gaps are too small, the bowl-shaped sound source 910 will not be able to move a minute distance so that when the hammer 34 strikes the bowl-shaped sound source 910, the energy transferred to the bowl-shaped sound source 910 will be spent on deformation of the bowl-shaped sound source 910 and the sound source mounting plate 920, attenuating vibration of the bowl-shaped sound source 910 and shortening the reverberations.

However, by suitably setting these gaps, the bowl-shaped sound source 910 can move a minute distance so that when the hammer 34 strikes the bowl-shaped sound source 910, the energy transferred to the bowl-shaped sound source 910 will not be spent deforming the bowl-shaped sound source 910 and the sound source mounting plate 920, attenuation of the vibration of the bowl-shaped sound source 910 is inhibited and the sound source thus reverberates for a longer time.

Holes 913 that are used to screw the set screws 926 into the pins 923 are also formed at appropriate positions in the bottom 912 of the bowl-shaped sound source 910.

A through-hole 914 for inserting the stem 36A of the crown 36 is also formed in the side wall 911 of the bowl-shaped sound source 910.

A through-hole 1B for inserting the stem 36A is also rendered in the outside case member 1A of the timepiece 1 in which the bowl-shaped sound source 910 and the movement 11 are disposed.

The fixed arms 922 of the sound source mounting plate 920 are flexible, and the bowl-shaped sound source 910 is suspended so that the bowl-shaped sound source 910 does not normally contact parts (such as the movement 11 and the case member 1A) other than the sound source mounting plate 920. More specifically, the flexibility (elasticity) of the fixed arms 922 is set to a strength (rigidity) preventing the bowl-shaped sound source 910 from moving to a position in contact with the movement 11 and the case member 1A during normal use.

If the timepiece 1 is dropped or otherwise subjected to a strong shock, the flexible sound source mounting plate 920 could be deformed by the weight of the bowl-shaped sound source 910. If this deformation exceeds the elastic deformation range of the sound source mounting plate 920, the sound source mounting plate 920 will be plastically deformed.

A plurality of backup parts 930 limiting movement of the bowl-shaped sound source 910 are therefore disposed to the case member 1A, which includes the body and the back case of the timepiece 1. These backup parts 930 are small blocks located at 90 degree intervals around the outside of the bowl-shaped sound source 910 at the inside circumference of the case. The backup parts 930 each have a receiving surface 931 that conforms to the shape of the outside surface of the bowl-shaped sound source 910 and is located a prescribed distance from the bowl-shaped sound source 910.

If the timepiece 1 is dropped, for example, so that the bowl-shaped sound source 910 is subject to a strong force causing the bowl-shaped sound source 910 to move, the bowl-shaped sound source 910 will contact the receiving surface 931 of one or more of the backup part 930 and thus be prevented from moving further.

* Operation of the Sonnerie Mechanism

The operation of the sonnerie mechanism 3 thus comprised is described briefly below.

Torque from the barrel wheel 31 is normally transferred through the speed increasing wheel train 32 to the center wheel 80, and this torque urges the center wheel 80 counterclockwise as seen in FIG. 1. The center wheel 80 does not turn and remains stationary, however, because the toothless portion 871 of the gathering rack pinion 87 and the stop 76 of the hour repeating rack 70 are pressed together.

When the cannon pinion 7 then turns, the stud 41 on the screw nut 40 contacts the beak 62, and the release lever 60 turns counterclockwise as seen in FIG. 1, the release lever click 63 engaged with the triangular teeth 821 causes the release ratchet 82 to turn. The release pin 84 therefore moves in the oblong hole 813 of the driving roller 81, and moves circularly counterclockwise as seen in FIG. 1 against the force of the center wheel release click spring 86 that pushes the center wheel release click 85 towards the center of the center wheel 80.

As a result, the pawl 853 of the center wheel release click 85 engaged with the triangular teeth 891 of the driving ratchet 89 disengages the triangular teeth 891.

When the pawl 853 releases, the gathering rack pinion 87 can rotate freely on the driving roller 81. As a result, the hour repeating rack 70, which turns counterclockwise as seen in FIG. 1 due to the force of the deflected hour repeating rack spring 77, causes the gathering rack pinion 87 that is engaged with the teeth 75 of the hour repeating rack 70 to rotate instantaneously counterclockwise as seen in FIG. 1 until the distal end of the hour repeating rack click 73 contacts a face 52A of the snail wheel 50.

The hour ratchet 90 affixed to the gathering rack pinion 87 therefore turns clockwise while the triangular teeth 901 on the outside of the hour ratchet 90 trip the hammer trip 341 attached freely rotatably on the support pin of the hammer 34.

The outside circumference of the snail plate 52 of the snail wheel 50 contacted by the distal end of the hour repeating rack click 73 is divided into twelve parts rendering faces 52A (sides) each having a specific length from the center corresponding to the time. The angle that the center wheel 80 turns, that is, the angle that the hour repeating rack 70 turns, when the center wheel release click 85 disengages the driving ratchet 89 is therefore determined by the rotational position of the snail wheel 50.

More specifically, the snail wheel 50 has a star wheel 51 with twelve teeth 51A below the snail plate 52. When the screw nut 40 turns one revolution per hour in unison with the cannon pinion 7 (minute hand), the pin 42 press fit to the disk engages the star wheel 51 of the snail wheel 50 before the stud 41 contacts the beak 62, and the snail wheel 50 rotates the distance of one hour (1/12 revolution=30 degrees). Because a triangular tooth click is pressed against the star wheel 51, the snail wheel 50 also rotates with a click and is positioned.

The size of the gathering rack pinion 87, the hour repeating rack 70, and the snail wheel 50 are set so that when the center wheel release click 85 disengages, the number of triangular teeth 901 on the hour ratchet 90 that trip the hammer trip 341 is equal to the number of hours indicated by the snail wheel 50.

When the center wheel release click 85 disengages and is released from the gathering rack pinion 87, the driving roller 81 starts turning counterclockwise as seen in FIG. 1 as a result of the torque transferred from the barrel wheel 31 through the speed increasing wheel train 32 and center wheel pinion 83.

The rotational speed of the driving roller 81 is determined by the speed of the barrel wheel 31, and the barrel wheel 31 rotates at an extremely slow speed as controlled by the governor 2 described above.

When the driving roller 81 turns in unison with the center wheel pinion 83, the force of the center wheel release click spring 86 causes the center wheel release click 85 that was raised by the release pin 84 to again engage the driving ratchet 89 because the release ratchet 82 remains pressed against the release lever click 63 and held stationary.

As a result, the gathering rack pinion 87 is constrained by the center wheel release click 85 and turns counterclockwise in unison with the driving roller 81.

The triangular teeth 901 of the hour ratchet 90 riding over the hammer trip 341 push and cause the hammer trip 341 to move counterclockwise. This circular movement of the hammer trip 341 causes the hammer 34 to lift away from the bowl-shaped sound source 910 in resistance to the urging force of the hammer spring 342. As the hour ratchet 90 continues to turn and the triangular tooth 901 disengages the hammer trip 341, the hammer spring 342 returns the hammer 34 towards the bowl-shaped sound source 910 and causes the hammer 34 to strike the bowl-shaped sound source 910.

The bowl-shaped sound source 910 is struck each time the center wheel 80 turns and a triangular tooth 901 of the hour ratchet 90 trips the hammer trip 341. As a result, the bowl-shaped sound source 910 is struck according to the rotational position of the snail wheel 50, that is, the number of hours in the time read from the snail wheel 50. The user can therefore know the hour from the number of times the sound source sounds.

When the bowl-shaped sound source 910 sounds the number of hours in the time read from the snail wheel 50, the toothless portion 871 of the gathering rack pinion 87 contacts the stop 76 of the hour repeating rack 70, and the center wheel 80 stops turning.

The pawl 902 of the hour ratchet 90 therefore contacts the hammer trip 341 as shown in FIG. 1, and the hammer trip 341 is prevented from moving counterclockwise. The hammer trip 341 contacts the spring pin 343 of the hammer 34 at this time, and the hammer 34 is held at rest at a position separated from the bowl-shaped sound source 910. The bowl-shaped sound source 910 will therefore not sound when the sonnerie mechanism 3 is not operating, even if the hands are clapped or the wrist is shaken vigorously when the wristwatch is being worn.

When rotation of the cannon pinion 7 separates the beak 62 of the release lever 60 from the stud 41 of the screw nut 40, the force of the spring causes the release lever 60 to rotate clockwise and return to the initial position.

This completes the operation of the sonnerie (striking) mechanism 3.

Effect of the First Embodiment

This aspect of the present invention has the following effects.

(1) The center of the bottom 912 of the bowl-shaped sound source 910 is attached to the sound source mounting plate 920, and prescribed gaps L1 and L2 are provided between the sound source mounting plate 920 and the sound source mounting plate spacer 924 when the sound source mounting plate 920 is attached to the movement 11 in this embodiment of the invention. As a result, the sound source mounting plate 920 can move very slightly the distance allowed by these gaps when the hammer 34 strikes the bowl-shaped sound source 910. The striking energy transferred to the bowl-shaped sound source 910 is therefore not spent deforming parts of the sound source 910 or sound source mounting plate 920, vibration of the bowl-shaped sound source 910 is therefore not damped, and the sound emitted by the sound source lasts longer. A sound that reverberates much longer than the sound from a gong can thus be produced, the user can better enjoy the sound reverberations, and the passage of time can be signaled more pleasantly.

(2) The sound source mounting plate 920 is attached to the movement 11 at the distal ends of the fixed arms 922 instead of attaching the fixed portion 921 directly to the movement 11, and can therefore be attached while avoiding the center axis part of the movement 11. As a result, the pins 923 for affixing the sound source mounting plate 920 can be rendered by extending the length of the pins provided for attaching the timepiece movement bridge 11A to the movement 11, and the movement 11 does not need to be provided with new pins for attaching the sound source mounting plate 920. Changing the layout of other parts in the movement 11 is therefore not necessary and the cost can be reduced because the same movement 11 can be used in both timepieces with and without a sonnerie.

(3) The sound source mounting plate 920 is flexible with fixed arms 922 extending from a fixed portion 921, and the flexibility is set so that vibrations and impact during normal use will not cause the bowl-shaped sound source 910 to contact the case or movement 11. The bowl-shaped sound source 910 can thus be prevented from contacting the case, for example, and sounding during normal use.

(4) If the sound source mounting plate is not flexible, the likelihood is greater that the sound source mounting plate will immediately plastically deform when the timepiece 1 is dropped or otherwise subject to a sharp impact causing the bowl-shaped sound source 910 to move.

By using a flexible sound source mounting plate 920, however, the sound source mounting plate 920 will absorb the force of the movement of the bowl-shaped sound source 910 by means of elastic deformation and then return to the original position when the bowl-shaped sound source 910 moves insofar as this movement does not exceed the elastic deformation range of the sound source mounting plate 920.

(5) Furthermore, this embodiment of the invention has backup parts 930 disposed to the case so that when the bowl-shaped sound source 910 moves because the timepiece 1 was dropped, for example, the backup parts 930 receive and stop further movement of the bowl-shaped sound source 910 before the elastic deformation range of the sound source mounting plate 920 is exceeded. Plastic deformation of the sound source mounting plate 920 is thus reliably prevented, and the impact resistance of the timepiece 1 can be assured.

(6) The space inside a wristwatch or similarly small timepiece 1 can also be used efficiently by disposing the movement 11 inside the bowl-shaped sound source 910. This also enables making the bowl-shaped sound source 910 that is housed inside the timepiece as large as possible, and this further increases the length of the reverberations.

Furthermore, by rendering a through-hole 914 in the side wall 911 for passing the stem 36A, the bowl-shaped sound source 910 and the movement 11 do not need to be vertically separated, and the thickness of the timepiece 1 can be reduced accordingly.

A slot from the open end side of the side wall 911 could alternatively be provided for passing the stem 36A through the side wall 911, but such a slot affects vibration of the bowl-shaped sound source 910 and makes it difficult to produce a sound. By rendering a small through-hole 914 in the side wall 911, however, this embodiment of the invention minimizes the effect on vibration of the bowl-shaped sound source 910 and enables producing a sound with reverberation.

(7) If the bowl-shaped sound source 910 is attached to the back cover or other part of the case member 1A, removing the bowl-shaped sound source 910 and the back case becomes difficult because the stem 36A passes through the through-hole 914 and the through-hole 1B. By attaching the bowl-shaped sound source 910 to the movement 11, however, this embodiment of the invention enables removing the back cover from the case without removing the bowl-shaped sound source 910 from the movement 11, thus improving assembly and maintenance.

(8) The governor 2 according to this embodiment of the invention holds the operating speed of the sonnerie mechanism 3 that is driven by a barrel wheel 31 substantially constant by means of mechanical control, therefore does not require a control circuit or sensor, and therefore reduces cost and occupies little space. Furthermore, because the governor 2 is mechanical and does not require an electrical power supply, the governor 2 does not need to use power produced by a generator-governor when used in an electronically controlled mechanical timepiece 1, and therefore prevents shortening the operating time of an electronically controlled mechanical timepiece 1 as a result of increasing power consumption.

(9) The governor 2 is a contactless governor that utilizes the resistance of fluid viscosity, therefore does not produce wear particles, and eliminates soiling the mechanism and deterioration. The appearance is therefore not impaired by wear particles, periodic maintenance involving disassembling and cleaning to remove wear particles, replacing parts due to part wear, and adjustment is required less frequently, and the maintenance cost can therefore be reduced.

Furthermore, using a contactless governor that utilizes the resistance of fluid viscosity prevents noise. The absence of noise affords enjoying the clear, pure tone of the sonnerie mechanism when used in a timepiece 1 with a sonnerie mechanism.

(10) Because the rotor 200 rotates in only one direction with this governor 2, the damage and deterioration of colliding parts that is observed with a reciprocating swiss lever escapement can be prevented even if the rotor 200 turns at high speed.

Furthermore, because the governor 2 uses wings 210, the governor 2 can be rendered thinly and easily incorporated into a wristwatch 1.

(11) By using air as the viscous fluid, a housing or structure for sealing the viscous fluid is not required, and the governor can be easily rendered compactly and loss from the seal between the housing and axle can be prevented.

(12) The viscous load acting on the wings 210 can be increased by providing the opposing member 230 with opposing surfaces to the surfaces of the wings. The brake power per volume ratio can therefore be increased, and the governor 2 and a timepiece 1 incorporating the governor 2 can be made smaller. The speed increasing ratio of the drive power transfer wheel train 4 can therefore be reduced and the number of wheels in the wheel train can be reduced accordingly, thereby reducing the parts count, reducing cost, and improving space efficiency.

(13) By rendering an opposing plate 233 on both sides of the wings 210, the braking power of fluid viscosity resistance works on both sides of the wings 210, and the brake power can be increased compared with providing an opposing plate 233 on only one side while the rotor 200 in the governor 2 and the surface area of the opposing member 230 remain the same size.

Furthermore, because an opposing plate 233 is on each side of the wings 210, the total change in viscous resistance is small even if the wings 210 shift closer to one opposing plate 233 due to shaking, for example, because the gap to the other opposing plate 233 also increases. The speed of the governor 2 therefore remains stable and the operating speed of the device also remains substantially constant.

(14) The wings 210 are prevented from contacting other parts even if greater than expected torque is applied to the rotor 200 due to impact when the timepiece is worn or excessive force is applied to the wings 210 because the excessive wing movement prevention means that limits how far the wings 210 can fly to the outside prevents the wings 210 from moving outside from the preset position. In addition, the excessive wing movement prevention means can be rendered using only the spring catch stud 206 and finger 213, and is therefore simple, lightweight, and inexpensive.

(15) The wings 210 are positioned so that the weight of the plural wings is balanced. The balance is therefore held on the axis of rotation even when viscous resistance acts on the wings 210, the rotor 200 is prevented from tilting or rotating off-axis, and the rotor 200 therefore continues to rotate stably.

(16) Part of the outside edge of the wings 210 is shaped to overlap a circle that is concentric to the axis of rotation of the rotor when the wings 210 are spread to the maximum outside position, thereby maximizing the area where the wings 210 overlap the opposing member 230 when the wings 210 are at the maximum outside position, increasing the area near the outside part of the wings where the peripheral velocity is highest, and increasing the brake power. Brake power is therefore high relative to the size of the governor 2, and a governor 2 that produces sufficient brake power and is also space efficient can be provided.

(17) By using a flat zigzag spring 220 as the wing returning means, the thinness of the spring can be balanced by the amount of deflection, thus affording a thin rotor 200 and governor 2. A thin profile can therefore be achieved even when stacked with the wings 210, thus affording greater freedom in the horizontal layout. The wing members and spring can also be rendered in unison, thereby reducing the parts cost and assembly cost.

Furthermore, because the zigzag spring 220 has two zigzag spring parts 222 corresponding to the two wings 210 and a spring positioning part 221 rendered in unison connecting the two zigzag spring parts 222, only one positioning place is needed, a compact spring is afforded, the spring can be manufactured with fewer steps, and assembly and handling are easier.

(18) The wings 210 are substantially crescent shaped, axially supported freely rotatably to the rotor 200 by an intervening wing pin 211, and the wing pin 211 is rendered offset to one end from the center of gravity of the wing. As a result, friction resistance from the wing 210 support structure is reduced, the wings 210 can move smoothly, and the rotational speed of the governor 2 can be stabilized compared with wings that move parallel to the radial direction of the rotor 200.

(19) Spring deformation is also reduced when the wings 210 pivot because the zigzag spring 220 is attached offset toward the wing pin 211 from the center of gravity. As a result, the zigzag spring 220 is easier to set, and the zigzag spring 220 expands and contracts smoothly. Furthermore, because displacement of the zigzag spring 220 in the direction of rotation can be reduced, twisting of the zigzag spring 220 is reduced and the spring can expand and contract easily. There is also little sliding between the zigzag spring 220 and wing spring catch pin 212 and little concern about wear when the ring-shaped or C-shaped end of the spring 220 is hooked on the pin 212.

Second Embodiment

Figure 13:
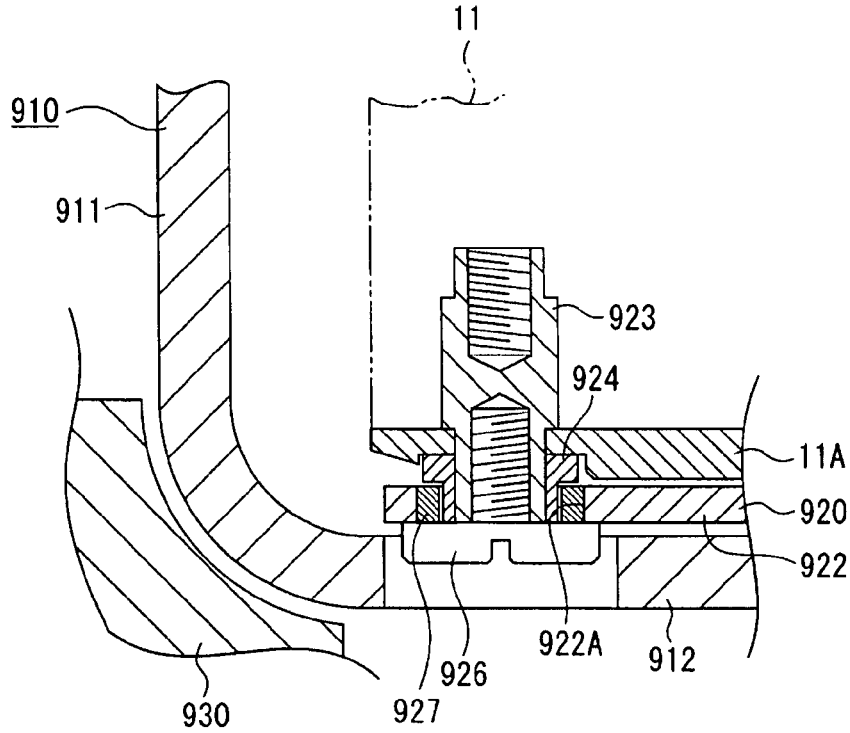
FIG. 13 is an enlarged section view showing a main part of the fastening assembly of the bowl-shaped sound source in a second embodiment of the invention.

A second embodiment of the invention is described next with reference to FIG. 13. This second embodiment differs from the first embodiment by using a different arrangement for attaching the sound source mounting plate 920 and the movement 11. Other aspects of this embodiment are the same as in the first embodiment, and further description thereof is thus omitted.

This aspect of the invention has a rubber bushing 927 disposed in each of the holes 922A of the sound source mounting plate 920.

These rubber bushings 927 are made from a material (rubber) that is more flexible, that is, deforms with less force, than the sound source mounting plate 920.

Because these rubber bushings 927 deform when the hammer 34 strikes, the energy transferred to the bowl-shaped sound source 910 will not be spent deforming the bowl-shaped sound source 910 and the sound source mounting plate 920, attenuation of the vibration of the bowl-shaped sound source 910 is inhibited and the sound source thus reverberates for a longer time without rendering prescribed gaps as in the first embodiment between the rubber bushing 927 and the sound source mounting plate spacer 924.

This aspect of the invention affords the same benefits as the first embodiment of the invention.

Third Embodiment

Figure 14:
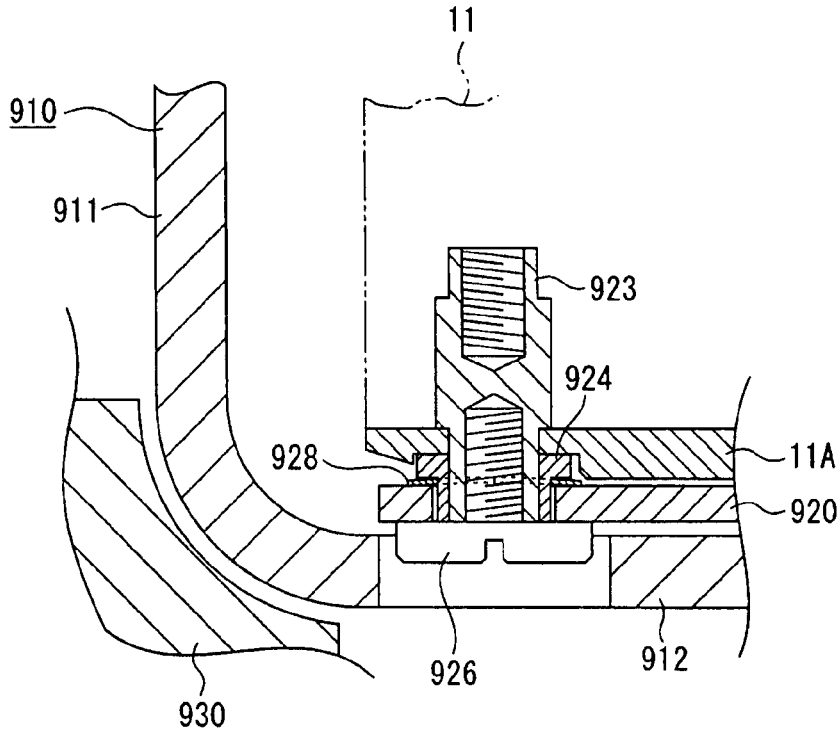
FIG. 14 is an enlarged section view showing a main part of the fastening assembly of the bowl-shaped sound source in a third embodiment of the invention.

A third embodiment of the invention is described next with reference to FIG. 14. This third embodiment also differs from the first embodiment by using a different arrangement for attaching the sound source mounting plate 920 and the movement 11. Other aspects of this embodiment are the same as in the first embodiment, and further description thereof is thus omitted.

This third embodiment of the invention inserts a ring-shaped flat spring 928 such as a dial washer between the sound source mounting plate spacer 924 and the sound source mounting plate 920. The flat spring 928 is made by rendering phosphor bronze or other spring material in the shape of a Belleville or curved disc spring.

When the hammer 34 strikes in this arrangement and the bowl-shaped sound source 910 moves a slight distance against the sound source mounting plate spacer 924, the spring force of the flat spring 928 returns the bowl-shaped sound source 910 to the original position. This renders a self-centering mechanism causing the sound source mounting plate spacer 924 to automatically return to the center axis of the hole 922A in the bowl-shaped sound source 910.

This aspect of the invention affords the same benefits as the first embodiment of the invention.

In addition, the self-centering mechanism rendered by the flat springs 928 in this aspect of the invention automatically return the bowl-shaped sound source 910 struck by the hammer 34 to the original position. The distance between the hammer 34 and the side wall 911 thus remains constant, the hammer 34 always strikes the bowl-shaped sound source 910 with the same force, and the sound and reverberations can thus also be kept constant.

Fourth Embodiment

Figure 15:
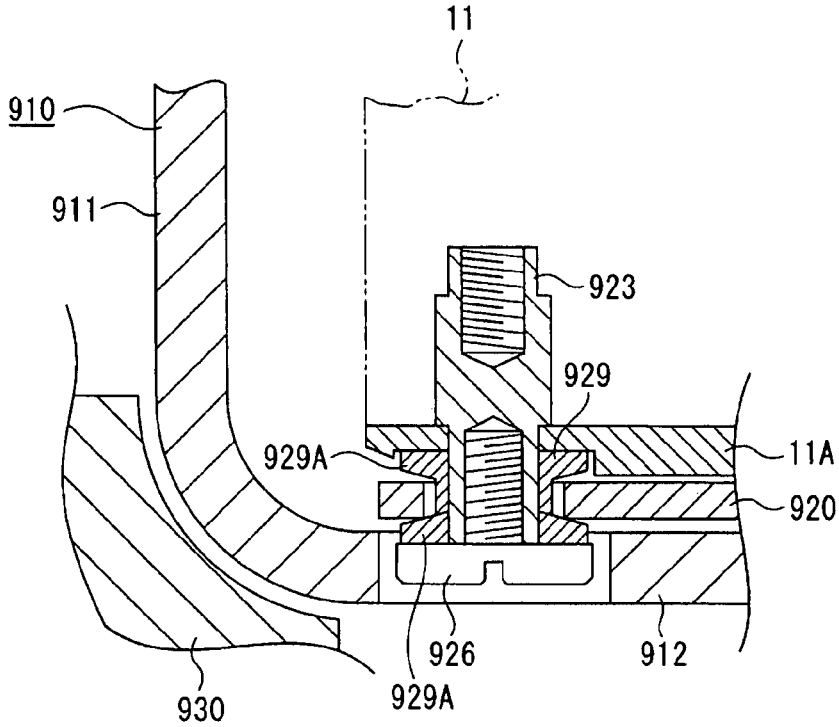
FIG. 15 is an enlarged section view showing a main part of the fastening assembly of the bowl-shaped sound source in a fourth embodiment of the invention.

A fourth embodiment of the invention is described next with reference to FIG. 15. This fourth embodiment also differs from the first embodiment by using a different arrangement for attaching the sound source mounting plate 920 and the movement 11. Other aspects of this embodiment are the same as in the first embodiment, and further description thereof is thus omitted.

This fourth embodiment of the invention uses a sound source mounting plate spacer 929 with flanges 929A on both ends instead of using the sound source mounting plate spacer 924 described above.

The flanges 929A of the sound source mounting plate spacer 929 are shaped so that the opposing surfaces of the flanges are inclined and become gradually closer together from the outside circumference of the sound source mounting plate spacer 929 to the center axis.

The sound source mounting plate spacers 929 are split into two parts at the flange 929A and are installed by fitting one half of the sound source mounting plate spacer 929 over the pin 923, then placing the sound source mounting plate 920 over the sound source mounting plate spacer 929, then fitting the other half of the sound source mounting plate spacer 929 to the first half of the sound source mounting plate spacer 929, and finally screwing in the set screw 926 to unify the sound source mounting plate spacer 929.

When the hammer 34 strikes in this arrangement and the bowl-shaped sound source 910 moves a slight distance against the sound source mounting plate spacer 924, the sound source mounting plate 920 rides up the inclined surface of the flanges 929A and then the sound source mounting plate 920 slides of its own weight back down the incline. The sound source mounting plate spacer 929 thus renders a self-centering mechanism that causes the bowl-shaped sound source 910 to automatically return to the original position if the bowl-shaped sound source 910 moves.

This aspect of the invention affords the same benefits as the first and third embodiments of the invention.

In addition, by rendering a self-centering mechanism that uses the inclines of the flanges 929A of the sound source mounting plate spacers 929 and the weight of the bowl-shaped sound source 910 and the sound source mounting plate 920, the bowl-shaped sound source 910 can easily move a small amount when the hammer 34 strikes the bowl-shaped sound source 910, and the bowl-shaped sound source 910 can be easily returned to the original position when striking ends. The reverberations can thus be sustained for a sufficient period of time and the tone can be kept constant.

Fifth Embodiment

Figure 16:
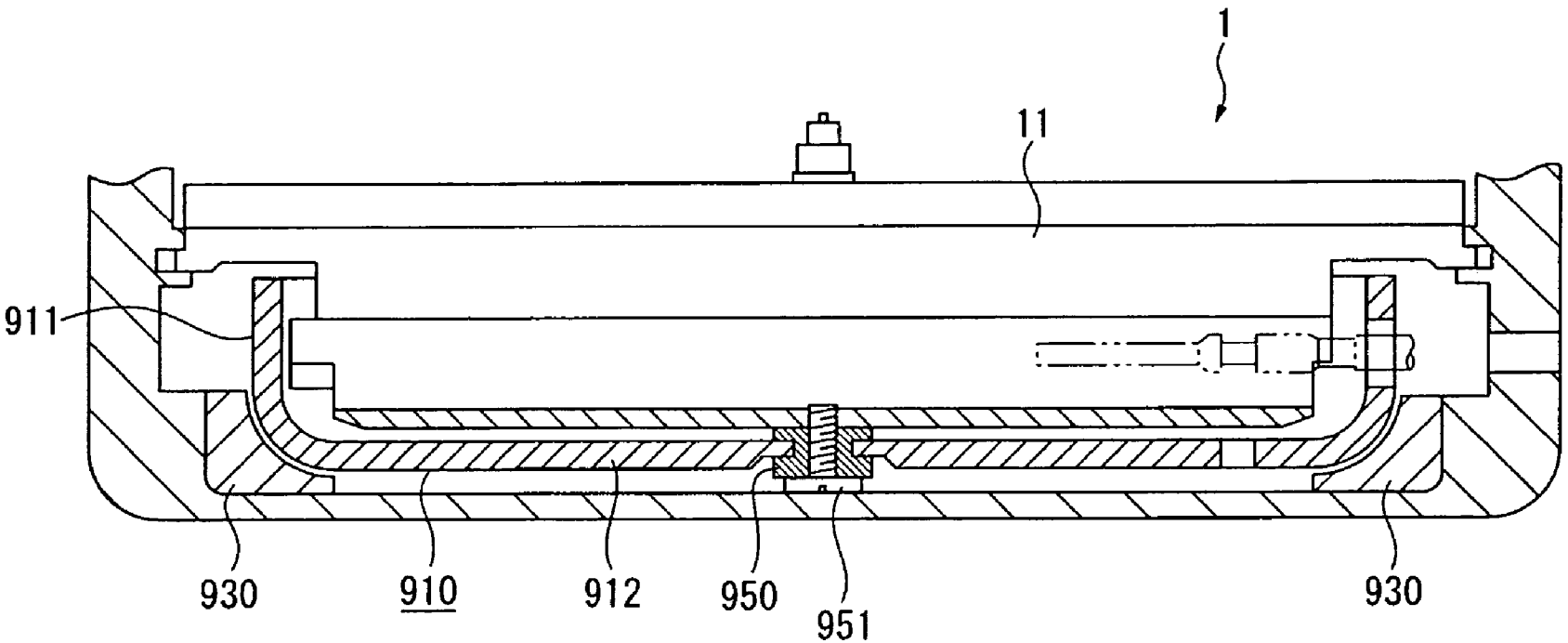
FIG. 16 is a section view of the fastening assembly of the bowl-shaped sound source in a fifth embodiment of the invention.

A fifth embodiment of the invention is described next with reference to FIG. 16. Instead of using a sound source mounting plate 920 as in the foregoing embodiments, this fifth embodiment of the invention fixes a sound source fastening member 950 that is a rubber bushing to the movement 11 with a screw 951, and fastens this sound source fastening member 950 to the center of the bottom 912 of the bowl-shaped sound source 910.

When the hammer 34 strikes the bowl-shaped sound source 910 in this embodiment of the invention, the sound source fastening member 950 deforms so that the bowl-shaped sound source 910 can move slightly. As in the foregoing embodiments, the energy transferred to the bowl-shaped sound source 910 is therefore not spent on deformation of the bowl-shaped sound source 910, attenuation of the vibration of the sound source 910 is inhibited and the sound source thus reverberates for a longer time.

Using a rubber bushing as the sound source fastening member 950 also reduces the cost compared with the sound source mounting plate 920 described above.

The invention is not limited to the embodiments described above.

More specifically, the structure of the sound source mounting plate 920 is not limited to the foregoing, and there could be three or five or more fixed arms 922.

The backup parts 930 are also not limited to rib-like protrusions, and the backup part could be rendered around the entire inside circumference of the case member 1A in a shape conforming to the shape of the outside of the bowl-shaped sound source 910. The backup part 930 is also not absolutely essential, and an arrangement that does not have a backup part 930 is also conceivable.

The arrangement for fastening the sound source mounting plate 920 to the movement 11 could also be a combination of the arrangements described above.

For example, the sound source mounting plate spacers 929 of the fourth embodiment could be used in conjunction with the flat springs 928 of the third embodiment disposed between the sound source mounting plate spacer 929 and the sound source mounting plate 920. Because each of these arrangements is self-centering, the self-centering effect can be enhanced.

The timekeeping mechanism is also not limited to the foregoing movement 11, and could be rendered as a digital display module having a liquid crystal display and an IC chip. Note that a mechanism for operating the hammer 34 must be provided.

A timepiece having the bowl-shaped sound source 910 of the invention is not limited to timepieces having a sonnerie, and the present invention can be used in any timepiece having a mechanism for producing sound by a mechanical striking action such as a repeater, an alarm, or a timer.

* Working Models

Several working models were studied to determine the change in reverberation resulting from differences in the arrangement for securing the bowl-shaped sound source 910 using an intervening sound source mounting plate 920.

Four methods of attaching the bowl-shaped sound source 910 were studied, including (a) setting the prescribed gaps between the sound source mounting plate spacer 924 and the sound source mounting plate 920 as in the first embodiment of the invention (where L1=L2=0.03 mm), (b) disposing a rubber bushing 927 between the sound source mounting plate spacer 924 and the sound source mounting plate 920 as in the second embodiment, (c) not providing a gap between the sound source mounting plate spacer 924 and the sound source mounting plate 920 and only lightly tightening the set screws 926 so that there is enough play for the sound source mounting plate 920 to move, and (d) not providing a gap between the sound source mounting plate spacer 924 and the sound source mounting plate 920 and firmly tightening the set screws 926 so that the sound source mounting plate 920 cannot move relative to the timepiece movement bridge 11A.

Figure 17:
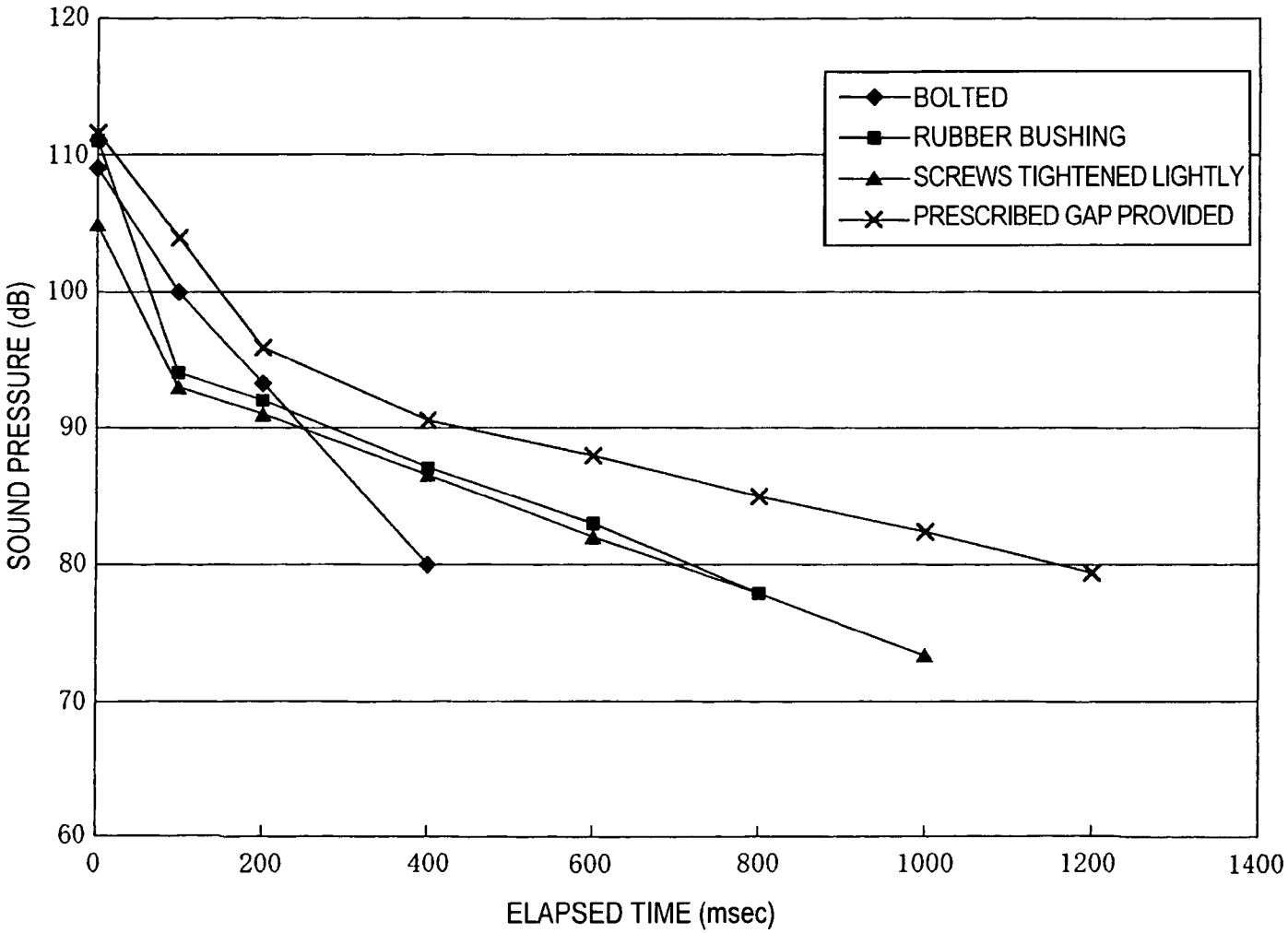
FIG. 17 is a graph showing test results using a working model of the invention.

The change in sound pressure from the time the hammer 34 struck the bowl-shaped sound source 910 was measured with each of these arrangements and the results graphed in FIG. 17.

When the sound source mounting plate 920 was secured by firmly tightening the set screw 926, the sound pressure dropped abruptly in a short time as denoted by the "bolted" curve shown in FIG. 17. More specifically, the sound source vibrated at a high frequency for only a short time, and there was substantially no reverberation.

With the other three attachment methods that allowed the sound source mounting plate 920 to move slightly, a first order frequency vibration continued for a relatively long time after the initial high frequency vibration, and the emitted sound reverberated. More particularly, when a gap of a prescribed size is provided, vibration continues for a long time at a relatively high sound pressure level, and the reverberation can be sustained for a desirably long time as indicated by the curve for the arrangement having a gap as shown in FIG. 17. This confirmed the practicality of the present invention.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2006-189812, filed Jul. 10, 2006 is expressly incorporated by reference herein.

What is claimed is:

1. A timepiece comprising:

a timekeeping mechanism for keeping and displaying the time;

a hammer;

a bowl-shaped sound source that sounds when struck by the hammer;

a sound source mounting member for fastening the bowl-shaped sound source to the timekeeping mechanism; and a striking control means for causing the hammer to operate, the bowl-shaped sound source having a bottom part and a side wall part, the hammer, the striking control means, and at least a part of the timekeeping mechanism being arranged in an internal space between the bottom part and the side wall part of the bowl-shaped sound source, the sound source mounting member being attached to the center of the bottom part of the bowl-shaped sound source, the sound source mounting member fastening the bowl-shaped sound source to the timekeeping mechanism so that the bowl-shaped sound source moves a prescribed distance, when struck, the bowl-shaped sound source being configured not to contact a case of the timepiece or the timekeeping mechanism, when moving.

2. The timepiece described in claim 1, wherein the sound source mounting member has a fixed part that is attached to the bottom part of the bowl-shaped sound source, and a plurality of fixed arm parts protruding from the fixed part, the fixed arm parts are attached with a prescribed intervening gap to the timekeeping mechanism, and this gap enables the bowl-shaped sound source to move the prescribed distance.

3. The timepiece described in claim 1, wherein the sound source mounting member has a fixed part that is attached to the bottom part of the bowl-shaped sound source, and a plurality of fixed arm parts protruding from the fixed part, the fixed arm parts are flexible and are attached to the timekeeping mechanism by an intervening spring member that has less spring strength than the fixed arm parts, and deformation of the spring member enables the bowl-shaped sound source to move the prescribed distance.

4. The timepiece described in claim 1, wherein the sound source mounting member is a rubber bushing that is attached to the bottom part of the bowl-shaped sound source and is attached to a plane center bottom of the timekeeping mechanism.

5. The timepiece described in claim 1, further comprising a backup part that is attached to an outside case and contacts the bowl-shaped sound source when the bowl-shaped sound source moves to prevent further movement beyond a range exceeding a elastic deformation limit of the sound source mounting member.

6. The timepiece described in claim 1, further comprising a self-centering mechanism for returning the bowl-shaped sound source to the original position of the bowl-shaped sound source after the bowl-shaped sound source moves.

* * * * *